US011572246B2

(12) United States Patent
Tashiro et al.

(10) Patent No.: US 11,572,246 B2
(45) Date of Patent: Feb. 7, 2023

(54) DOCUMENT CONVEYING APPARATUS THAT PROPERLY DISCHARGES DOCUMENTS REGARDLESS OF AMOUNT OF DOCUMENTS

(71) Applicant: KYOCERA Document Solutions Inc., Osaka (JP)

(72) Inventors: Yoshiaki Tashiro, Osaka (JP); Yoshitaka Tokoro, Osaka (JP); Kenichiro Kawasaki, Osaka (JP); Takafumi Nakagawa, Osaka (JP); Hirofumi Hagihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 184 days.

(21) Appl. No.: 17/076,522

(22) Filed: Oct. 21, 2020

(65) Prior Publication Data

US 2021/0114834 A1 Apr. 22, 2021

(30) Foreign Application Priority Data

Oct. 21, 2019 (JP) ..... JP2019-192177
Oct. 21, 2019 (JP) ..... JP2019-192178
Oct. 21, 2019 (JP) ..... JP2019-192180

(51) Int. Cl.
*B65H 29/50* (2006.01)
*B65H 31/10* (2006.01)
*B65H 29/12* (2006.01)

(52) U.S. Cl.
CPC ..... *B65H 31/10* (2013.01); *B65H 29/125* (2013.01); *B65H 29/50* (2013.01)

(58) Field of Classification Search
CPC ..... B65H 29/50; B65H 2405/3321; B65H 2405/332; B65H 2405/3322
See application file for complete search history.

(56) References Cited

U.S. PATENT DOCUMENTS 10,865,065 B2 * 12/2020 Ito ..... H04N 1/00602
11,312,588 B2 * 4/2022 Heineck ..... B65H 29/52
(Continued)

FOREIGN PATENT DOCUMENTS

JP H10-167545 A 6/1998
JP 2005-008283 A 1/2005

OTHER PUBLICATIONS

European Patent Office. Extended European Search Report of foreign counterpart, dated Mar. 9, 2021.
(Continued)

*Primary Examiner* — Howard J Sanders
(74) *Attorney, Agent, or Firm* — Hawaii Patent Services; Nathaniel K. Fedde; Kenton N. Fedde

(57) ABSTRACT

Provided is a document conveying apparatus that properly discharges documents regardless of the amount of documents stacked on a discharge tray without complicated construction of a transmission mechanism for transmitting a driving force to conveying rollers. A conveying roller pair is provided at an end portion on an upstream side. A swing mechanism swings a discharge mechanism centered around a drive shaft of the conveying roller pair. An upper surface height measuring unit measures the height of the upper surface of documents stacked on the discharge tray. A control unit, by causing the swing mechanism to swing the discharge mechanism according to the height measured by the upper surface height measuring unit, performs control so that the difference between a discharge port and the upper surface of the documents stacked on the discharge tray is within a specified range.

7 Claims, 23 Drawing Sheets

(56) References Cited

U.S. PATENT DOCUMENTS

| | | | | |
|---|---|---|---|---|
| 2019/0233225 | A1 | 8/2019 | Ito | |
| 2019/0233239 | A1 | 8/2019 | Shigeno | |
| 2019/0263616 | A1 | 8/2019 | Fujiwara | |
| 2019/0367315 | A1* | 12/2019 | Fujii | H04N 1/00588 |

OTHER PUBLICATIONS

China National Intellectual Property Administration. Office Action of foreign counterpart, dated Jul. 11, 2022.

* cited by examiner

DOCUMENT CONVEYING APPARATUS THAT PROPERLY DISCHARGES DOCUMENTS REGARDLESS OF AMOUNT OF DOCUMENTS

INCORPORATION BY REFERENCE

This application is based on and claims the benefit of priority from Japanese Patent Application No. 2019-192180, 2019-192177, and 2019-192178, which were filed on Oct. 21, 2019, the contents of which are hereby incorporated by reference.

BACKGROUND

The present disclosure relates to a document conveying apparatus that conveys documents to a reading position and a document reading apparatus that includes the document conveying apparatus.

In recent years, there has been an increasing demand for higher speed and larger capacity of a document reading apparatus having a document conveying apparatus for conveying a document to a reading position, and in order to meet the demand, various functions such as improvement of reading speed, increase of the document stacking amount, prevention of double feeding and paper jams, support of various basis weights and sizes, and the like are being improved. For example, in a typical technique, a document feeding apparatus is proposed that includes an raising/lowering unit that raises and lowers a paper-supply tray and a raising/lowering control unit that causes the paper-supply tray to be raised according to the feeding of a document from the paper-supply tray, and is configured so that a discharge port of a paper-discharge tray moves up and down by the same amount that the paper-supply tray moves up and down. More specifically, the paper-supply tray, in a state in which a document has not been stacked, is set to the lowest position based on a detection signal from a lower limit sensor that detects that a lower limit position has been reached, and when a document is stacked, the placement of the document is detected by a document presence/absence sensor that is provided at a proper position near the paper-supply tray, and the paper-supply tray is raised based on the detection signal until the upper surface of the bundle of documents comes into contact with a pickup roller.

SUMMARY

A document conveying apparatus according to the present disclosure includes: a paper-supply tray on which documents are stacked; a discharge tray provided below the paper-supply tray; a feeding roller that feeds out the documents one sheet at a time from the paper-supply tray; a conveying mechanism that conveys the fed documents along a conveying path that passes by a reading position; a discharge mechanism that conveys the documents along a discharge path connected to the conveying path and discharges the documents to the discharge tray from a discharge port provided at an end portion on a downstream side in a conveying direction of the discharge path; a conveying roller pair provided at an end portion on an upstream side in the conveying direction of the discharge path; a swing mechanism that swings the discharge mechanism centered around a drive shaft of the conveying roller pair; a raising/lowering mechanism that raises or lowers the paper-supply tray so that the upper surface of the documents stacked on the paper-supply tray is pressed against the feeding roller; an upper surface height measuring unit that measures the height of the upper surface of the documents stacked on the discharge tray; and a control unit that, by causing the swing mechanism to swing the discharge mechanism according to the height measured by the upper surface height measuring unit, performs control so that a difference between the discharge port and the upper surface of the documents stacked on the discharge tray are within a specified range.

A document conveying apparatus according to the present disclosure includes: a paper-supply tray on which documents are stacked; a discharge tray provided below the paper-supply tray; a feeding roller that feeds out the documents one sheet at a time from the paper-supply tray; a conveying mechanism that conveys the fed documents along a conveying path that passes by a reading position; a discharge mechanism that conveys the documents along a discharge path connected to the conveying path and discharges the documents to the discharge tray from a discharge port provided at an end portion on a downstream side in a conveying direction of the discharge path; a swing mechanism at an end portion on the upstream side in the conveying direction of the discharge path and including a swing shaft, an axial direction of which is a width direction of the documents orthogonal to the conveying direction, and that swings the discharge mechanism centered around the swing shaft; a raising/lowering mechanism that raises or lowers the paper-supply tray so that the upper surface of the documents stacked on the paper-supply tray is pressed against the feeding roller; an upper surface distance measuring unit provided above the discharge port position at an upper limit of a swingable range of the discharge mechanism, and that measures the height of the upper surface of the documents stacked on the discharge tray; and a control unit that, by causing the swing mechanism to swing the discharge mechanism according to the height measured by the upper surface height measuring unit, performs control so that a difference between the discharge port and the upper surface of the documents stacked on the discharge tray is within a specified range.

A document conveying apparatus comprising: a paper-supply tray on which documents are stacked; a discharge tray provided below the paper-supply tray; a feeding roller that feeds out the documents one sheet at a time from the paper-supply tray; a conveying mechanism that conveys the fed documents along a conveying path that passes by a reading position; a discharge mechanism that conveys the documents along a discharge path connected to the conveying path and discharges the documents to the discharge tray from a discharge port provided at an end portion on a downstream side in a conveying direction of the discharge path; a swing mechanism at an end portion on the upstream side in the conveying direction of the discharge path and including a swing shaft, an axial direction of which is a width direction of the documents orthogonal to the conveying direction, and that swings the discharge mechanism centered around the swing shaft; a raising/lowering mechanism that raises or lowers the paper-supply tray so that the upper surface of the documents stacked on the paper-supply tray is pressed against the feeding roller; an upper surface distance measuring unit provided on a lower surface of the paper-supply tray, and that measures a distance to the upper surface of the documents stacked on the discharge tray; and a control unit that calculates the height of the upper surface of the documents stacked on the discharge tray based on the distance measured by the upper surface distance measuring unit and the height of the paper-supply tray obtained from a drive amount of the raising/lowering mechanism, and by causing the swing mechanism to swing the discharge mechanism according to the calculated height, performs control so that the difference between the discharge port and the upper surface of the documents stacked on the discharge tray is within a specified range.

DETAILED DESCRIPTION

First Embodiment

Hereinafter, a multifunction peripheral 100 of a first embodiment according to the present disclosure will be described with reference to the drawings. The multifunction peripheral 100 includes a printer 1 (an example of an image forming apparatus) and a scanner 8 (an example of a document reading apparatus).

Figure 1:
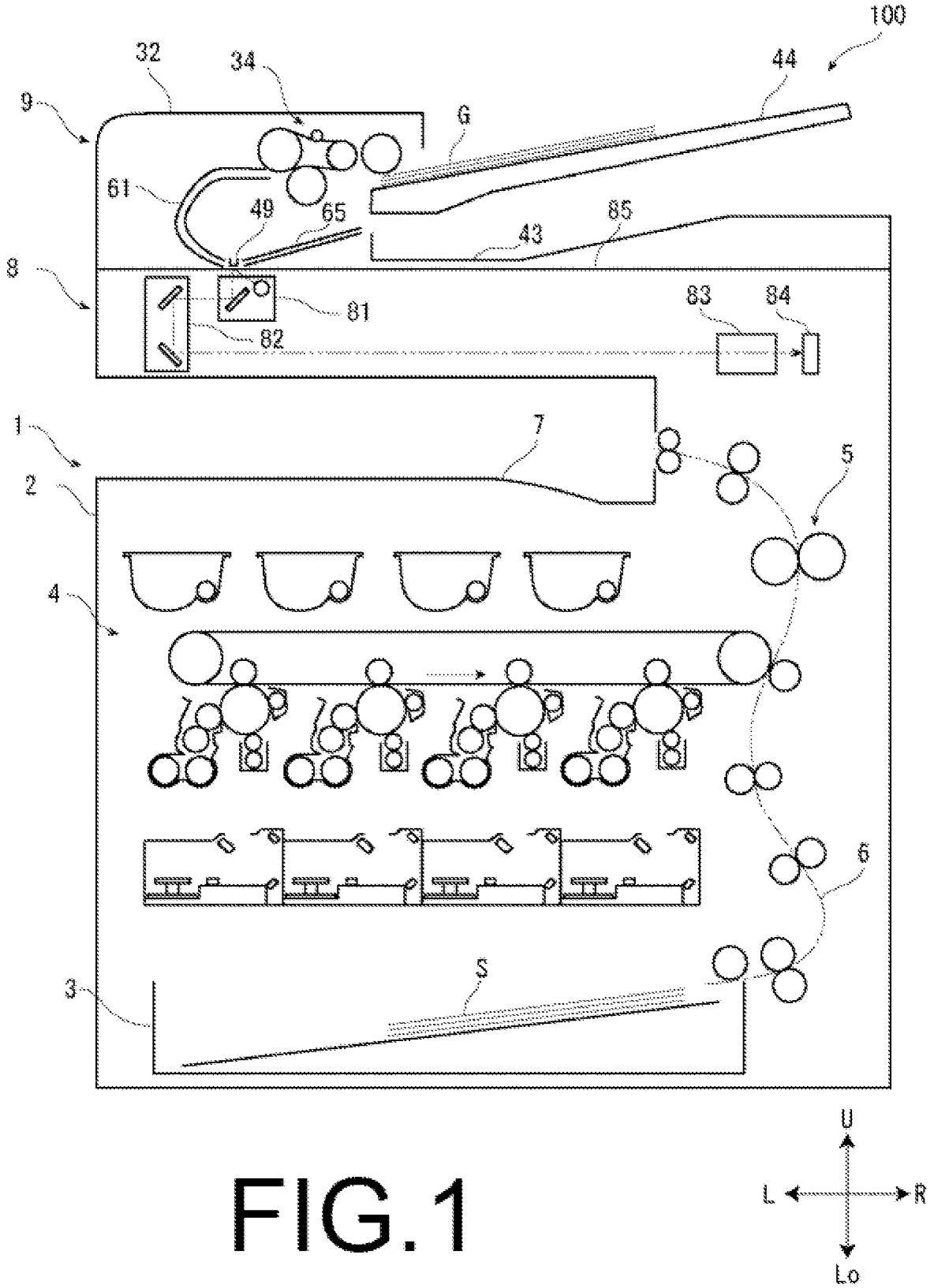
FIG. 1 is a front view schematically illustrating the internal configuration of a multifunction peripheral of a first embodiment and a second embodiment according to the present disclosure.

First, the overall configuration of the multifunction peripheral 100 will be described with reference to FIG. 1. FIG. 1 is a front view schematically illustrating the internal configuration of the multifunction peripheral 100. Hereinafter, the front side of the paper surface of FIG. 1 will be referred to as the front side of the multifunction peripheral 100, and the left and right directions will be described with reference to the directions when the multifunction peripheral 100 is viewed from the front. In each figure, U, Lo, L, R, Fr, and Rr represent upper, lower, left, right, front, and back respectively.

The printer 1 includes a rectangular box-shaped casing 2, and inside the casing 2, a paper-supply unit 3 that supplies sheets S, an image forming unit 4 that forms a full-color toner image by an electrophotographic method, a fixing unit 5 that fixes a toner image on a sheet S, and a discharge unit 7 that discharges a sheet S. Inside the casing 2, there is provided a conveying path 6 that extends from the paper-supply unit 3 to the discharge unit 7 via the image forming unit 4, the fixing unit 5.

When the printer 1 receives image data from an external computer or the like, a sheet S is fed out from the paper-supply unit 3 to the conveying path 6, a toner image is formed on the sheet S by the image forming unit 4, the toner image is fixed on the sheet S by the fixing unit 5, and the sheet S is discharged to the discharge unit 7.

The scanner 8 includes: a first carriage 81 including a light source and a reflecting mirror, a second carriage 82 including two reflecting mirrors, a lens 83 for focusing light, an imaging element 84 for converting focused light into an image signal, and a contact glass 85 on which a document G is stacked.

When a user places a document G on the contact glass 85 and gives a reading instruction to the scanner 8, light is emitted from the light source to the document G, and in conjunction with the first carriage 81 moving to the right at a speed V, the second carriage 82 moves to the right at a speed V/2. The reflected light reflected by the document G is reflected by the reflecting mirror of the first carriage 81 and the reflecting mirrors of the second carriage 82, guided to the lens 83, imaged by the imaging element 84, and converted into an image signal. The image signal is outputted to the printer 1 and converted into image data.

Figure 2:
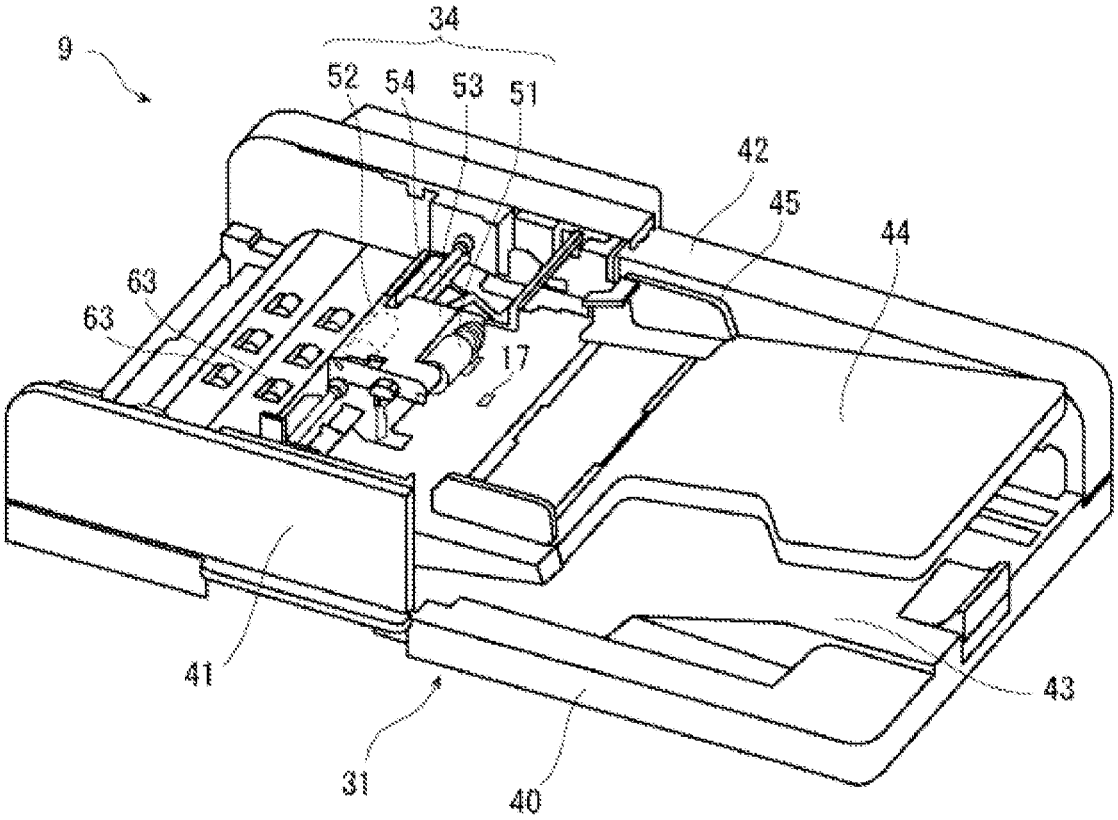
FIG. 2 is a perspective view of a document conveying apparatus of the first embodiment and the second embodiment according to the present disclosure.
Figure 2:
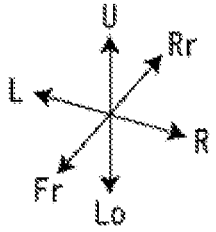
Figure 3:
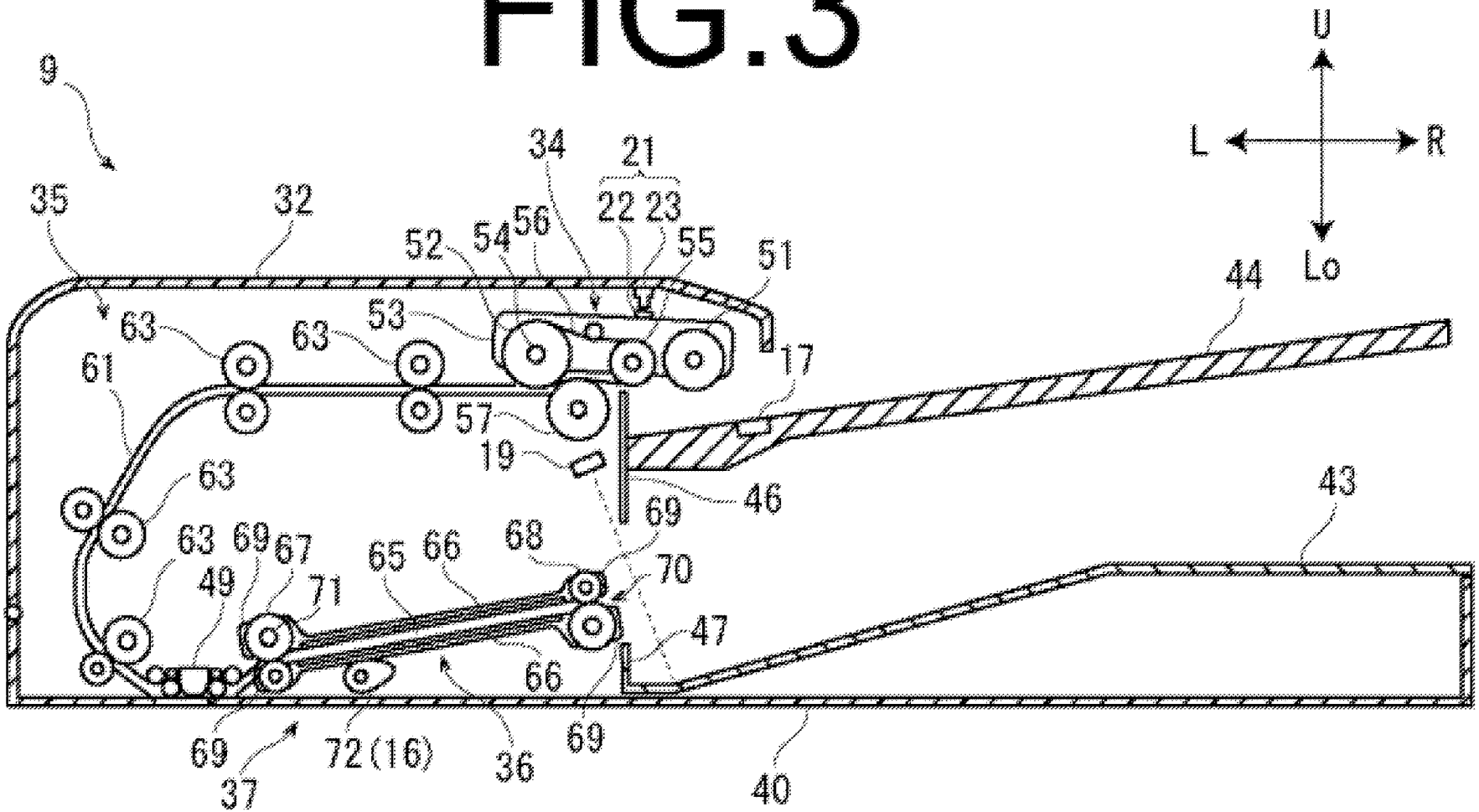
FIG. 3 is a cross-sectional view of the document conveying apparatus of the first embodiment and the second embodiment according to the present disclosure.
Figure 4A:
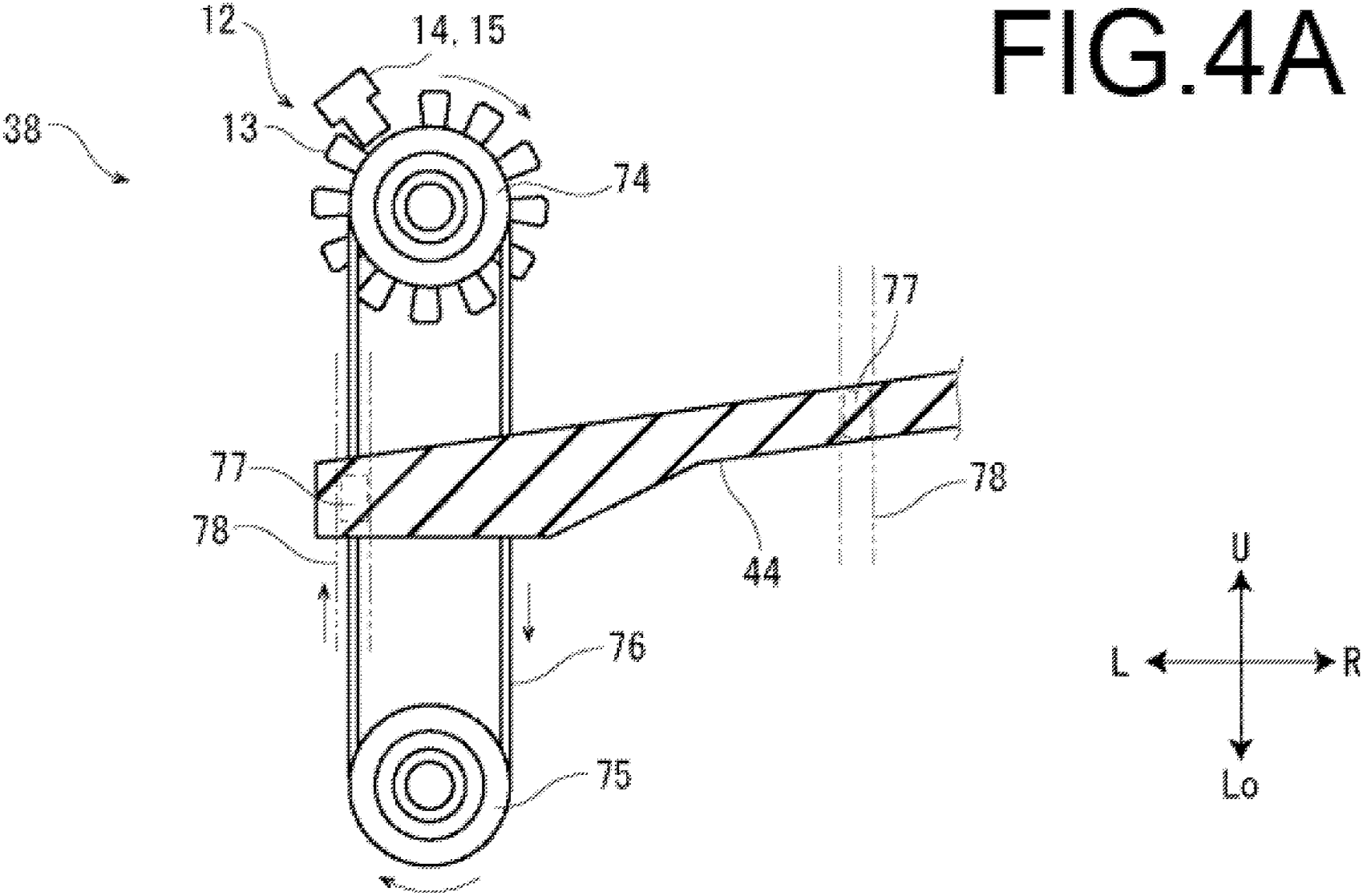
FIG. 4A is a front view of a raising/lowering mechanism of the first embodiment and the second embodiment according to the present disclosure.
Figure 4B:
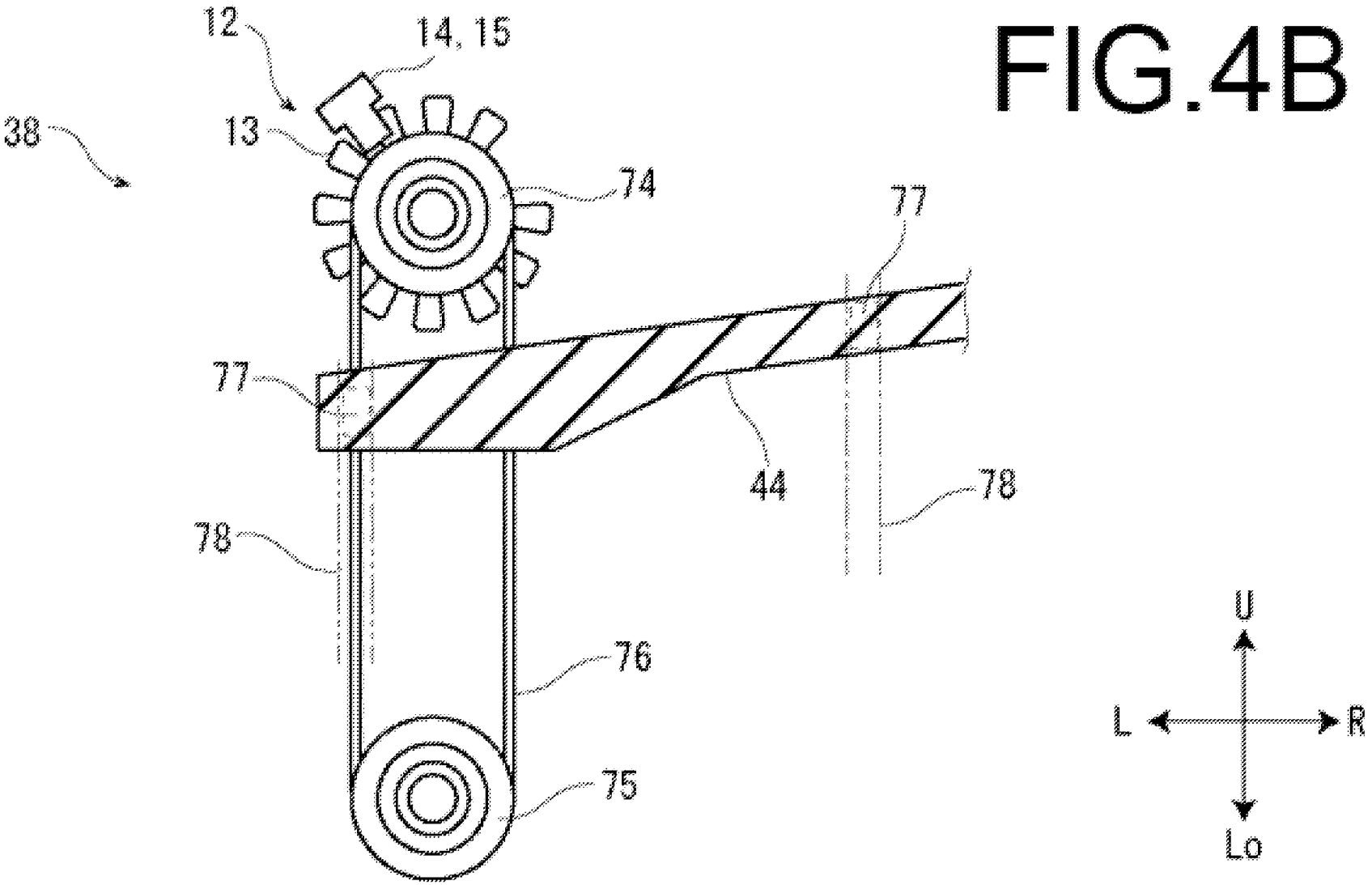
FIG. 4B is a front view of the raising/lowering mechanism of the first embodiment and the second embodiment according to the present disclosure.
Figure 5:
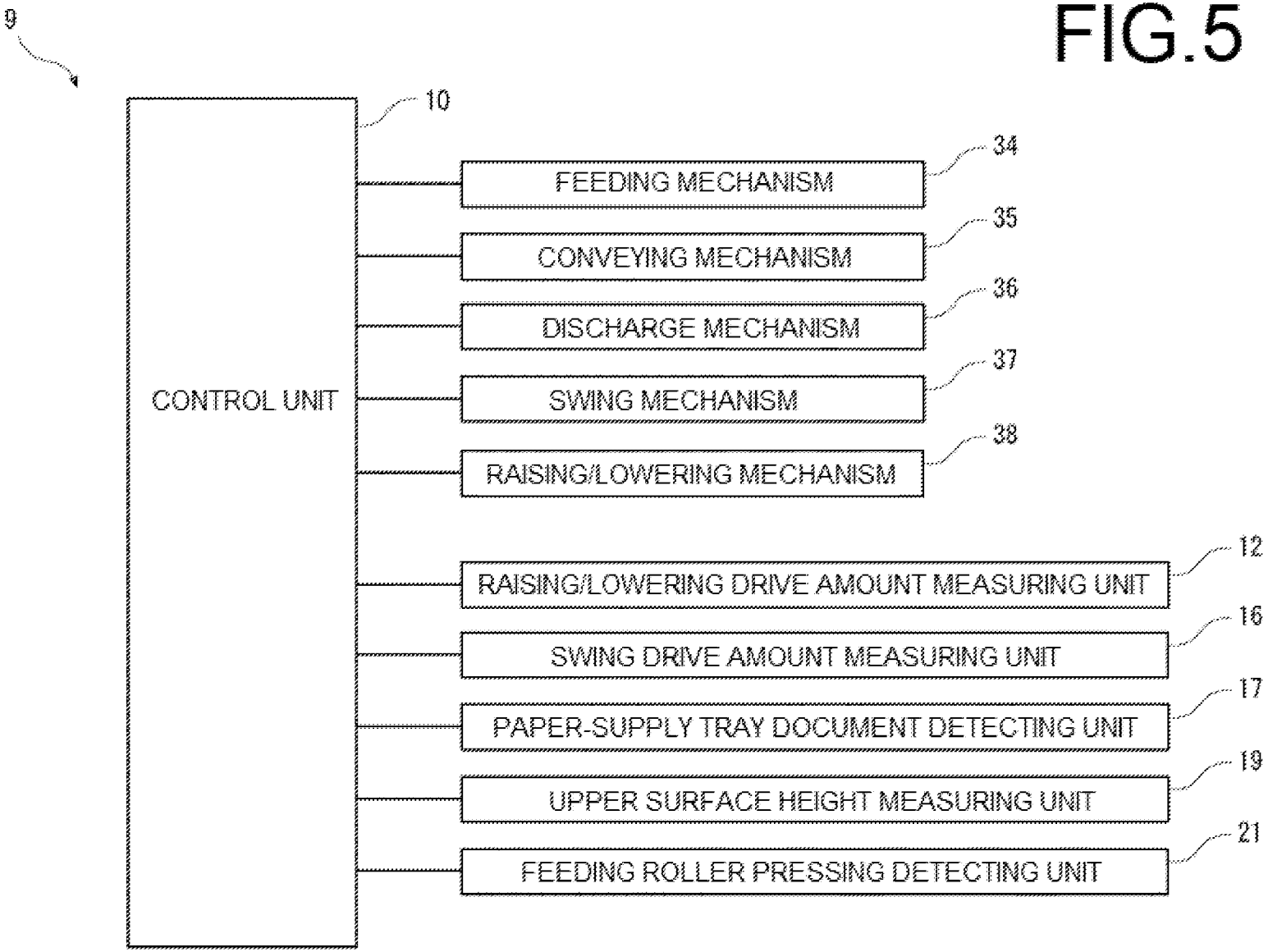
FIG. 5 is a block diagram illustrating an electrical configuration of the document conveying apparatus of the first embodiment and the second embodiment according to the present disclosure.
Figure 10:
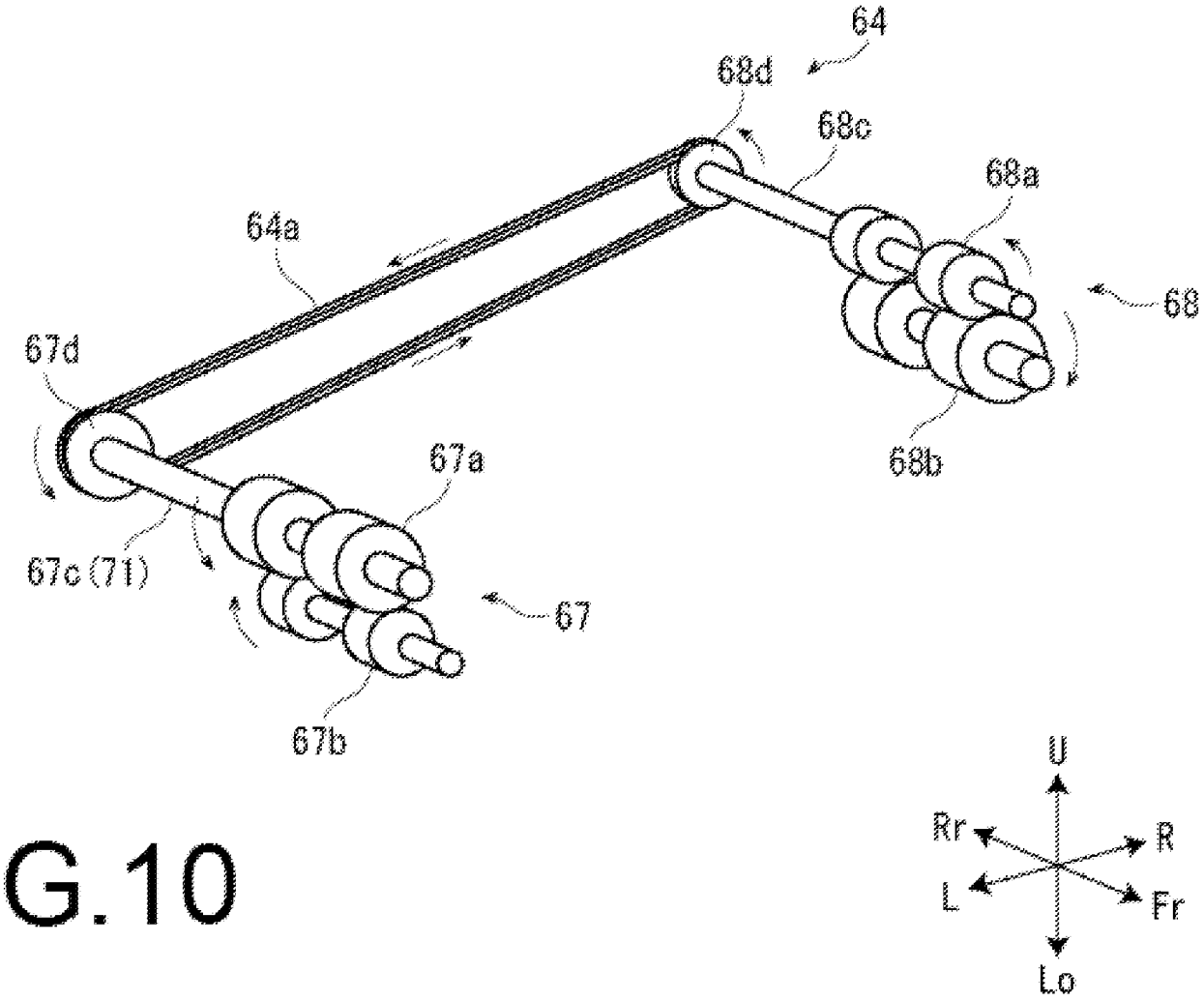
FIG. 10 is a perspective view illustrating a transmission mechanism of the first embodiment according to the present disclosure.

Next, the configuration of the document conveying apparatus 9 will be described with reference to FIGS. 1 to 5 and 10. FIG. 2 is a perspective view of the document conveying apparatus 9. FIG. 3 is a cross-sectional view of the document conveying apparatus 9. FIGS. 4A and 4B are front views of a raising/lowering mechanism 38. FIG. 5 is a block diagram illustrating an electrical configuration of the document conveying apparatus 9. FIG. 10 is a perspective view illustrating a transmission mechanism 64. Note that the cover portion 32 is not illustrated in FIG. 2.

The document conveying apparatus 9 includes: a paper-supply tray 44 on which the documents G are stacked; a discharge tray 43 provided below the paper-supply tray 44; a feeding roller 51 for feeding the documents G one sheet at a time from the paper-supply tray 44; a conveying mechanism 35 that conveys the fed documents G along the conveying path 61 via the reading position; a discharge mechanism 36 that conveys the documents G along a discharge path 65 connected to the conveying path 61 and discharges the documents G to a discharge tray 43 from a discharge port 70 provided at an end portion of the discharge path 65 on the downstream side in the conveying direction; a conveying roller pair 67 provided at an end portion on a upstream side in the conveying direction of the discharge path 65; a swing mechanism 37 that swings the discharge mechanism 36 centered around a drive shaft 67*c* of the conveying roller pair 67; a raising/lowering mechanism 38 that raises or lowers the paper-supply tray 44 so that the upper surface of a document G stacked on the paper-supply tray 44 is pressed against the feeding roller 51; an upper surface height measuring unit 19 for measuring the height of the upper surface of a document G stacked on the discharge tray 43; and a control unit 10 that, by causing the swing mechanism 37 to swing the discharge mechanism 36 according to the height measured by the upper surface height measuring unit 19, controls the difference between the discharge port 70 and the upper surface of the document G stacked on the discharge tray 43 so as to be within a specified range.

[Main Body]

The main body 31 (see FIG. 2) has a bottom portion 40 formed in a flat shape, and a first wall portion 41 and a second wall portion 42 facing each other in the front-rear direction (the width direction of the document G intersecting the conveying direction of the document G). The rear edge portion of the main body 31 is connected by a hinge to the rear of the contact glass 85 of the scanner 8 (see FIG. 1), and the main body 31 also includes a function of a pressing plate for pressing the document G on the contact glass 85. The first wall portion 41 is provided from the central portion to the left end portion of the front edge portion of the bottom portion 40, and the second wall portion 42 is provided over the entire rear edge portion of the bottom portion 40.

[Paper-Supply Tray, Discharge Tray]

The discharge tray 43 is formed on the right side of the center of the upper surface of the bottom portion 40, and the paper-supply tray 44 is provided above the discharge tray 43. The paper-supply tray 44 is a plate-like member that is inclined so that the left side becomes lower, and includes a cursor 45 that aligns the end portions of the document G in the front-rear direction. A paper-supply wall portion 46 that restricts the leftward movement of the stacked documents G is provided at a position adjacent to the left end portion of the paper-supply tray 44. Both front and rear end portions of the paper-supply wall portion 46 are fixed to the first wall portion 41 and the second wall portion 42. The discharge tray 43 is inclined so that the left side becomes lower, and a discharge wall portion 47 that restricts the leftward movement of a discharged document G is formed on the left end portion of the discharge tray 43.

[Feeding Mechanism]

The feeding mechanism 34 is provided in the space between the first wall portion 41 and the second wall portion 42 (see FIGS. 2 and 3). The feeding mechanism 34 includes a box-shaped holder 53 having an opened lower portion, and inside the holder 53 there is a feeding roller 51, a follower roller 55 provided on the left side of the feeding roller 51, a driving roller 52 provided on the left side of the follower roller 55, a rubber belt 56 wound around the driving roller 52 and the follower roller 55, and an auxiliary roller 57 pressed against the lower surface of a portion on the lower side of the belt 56. The feeding roller 51, the follower roller 55, the driving roller 52, and the auxiliary roller 57 are arranged with the front-rear direction as the axial direction. The feeding roller 51 includes a metal core and an elastic layer formed of rubber or the like (not shown). The follower roller 55, the driving roller 52, and the auxiliary roller 57 are made of resin or the like. Both the front and rear end portions of the drive shaft 54 of the driving roller 52 are supported by the first wall portion 41 and the second wall portion 42, and are connected to a drive source such as a motor (not shown) or the like. The holder 53 is supported by the drive shaft 54 and is able to swing centered around the drive shaft 54. The driving force of the drive shaft 54 is transmitted to the feeding roller 51 by a transmission mechanism (not shown) such as a gear train, a timing belt, or the like.

[Conveying Mechanism]

The conveying mechanism 35 (see FIG. 3) includes a conveying path 61 formed in a U-shaped curved shape extending from the feeding mechanism 34 to the upper right of the reading position via the reading position, and a plurality of conveying roller pairs 63 arranged in the conveying direction. The reading position is a position facing the reflecting mirror of the first carriage 81 (see FIG. 1) located at a home position. A shading plate 49 is provided at the reading position (see FIGS. 1 and 3), and a gap through which the document G is passed is provided between the shading plate 49 and the contact glass 85. The scanner 8 reads a document G passing by the reading position. The conveying path 61 is formed by plate-shaped conveying guide members facing each other with a gap for allowing the document G to pass through. Each conveying roller pair 63 includes a driving roller and a follower roller, and the driving roller is connected to a drive source (not shown) such as a motor or the like. A plate-shaped cover portion 32 that is able to be opened or closed is provided above the conveying mechanism 35. The left end portion of the cover portion 32 is connected by a hinge to the left end portion of the bottom portion 40 of the main body 31.

[Discharge Mechanism]

The discharge mechanism 36 includes: a discharge path 65 extending from the vicinity of the end portion on the downstream side in the conveying direction of the conveying path 61 to the discharge tray 43; a conveying roller pair 67 arranged at the end portion on the upstream side in the conveying direction of the discharge path 65; and a discharge roller pair 68 arranged at the end portion on the downstream side in the conveying direction of the discharge path 65. The discharge path 65 is formed by plate-shaped discharge guide members 66 facing each other with a gap for allowing the document G to pass through. The conveying roller pair 67 and the discharge roller pair 68 are supported by roller support portions 69 formed vertically at both the front and rear end portions of the discharge guide members 66.

As illustrated in FIG. 10, each conveying roller pair 67 includes a driving roller 67*a* and a follower roller 67*b*, and the driving roller 67*a* is connected to a drive source (not shown) such as a motor or the like. A drive pulley 67*d* is provided on the drive shaft 67*c* of the driving roller 67*a*. The discharge roller pair 68 includes a driving roller 68*a* and a follower roller 68*b*. A follower pulley 68*d* is provided on the drive shaft 68*c* of the driving roller 68*a*. A belt 64*a* is wound around the drive pulley 67*d* and the follower pulley 68*d*. The transmission mechanism 64 including the drive pulley 67*d*, the follower pulley 68*d*, and the belt 64*a* transmits the driving force from the drive shaft 67*c* of the conveying roller pair 67 to the discharge roller pair 68. A discharge port 70 through which the document G is discharged is formed in a contact region between the driving roller 68*a* and the follower roller 68*b* of the discharge roller pair 68.

[Swing Mechanism]

The swing mechanism 37 includes a swing shaft 71 and an eccentric cam 72. The swing shaft 71 is provided at the end portion on the upstream side in the conveying direction of the discharge path 65 with the front-rear direction as the axial direction. In the present embodiment, the drive shaft 67*c* of the conveying roller pair 67 also functions as the swing shaft 71. The eccentric cam 72 is able to swing centered around a cam shaft whose axial direction is the front-rear direction, and is connected to a drive source such as a motor or the like. A sliding surface of the eccentric cam 72 comes in contact with a lower surface of the lower discharge guide members 66. Swinging of the eccentric cam 72 causes the discharge mechanism 36 to swing centered around the swing shaft 71.

[Raising/Lowering Mechanism]

The raising/lowering mechanism 38 (see FIG. 4A) includes a drive pulley 74 and a follower pulley 75, and a belt 76 wound around the drive pulley 74 and the follower pulley 75. The raising/lowering mechanism 38 is provided in front of and behind the paper-supply tray 44, the drive pulley 74 is arranged above the paper-supply tray 44, and the follower pulley 75 is arranged below the paper-supply tray 44. The drive pulley 74 is connected to a drive source (not shown) such as a motor or the like. Two sliding portions 77 are formed in the left-right direction on the front and rear edge portions of the paper-supply tray 44, and sliding guide portions 78 are formed on the rear surface of the first wall portion 41 and the front surface of the second wall portion 42 to guide the sliding movement of the sliding portions 77 in the vertical direction. The sliding portions 77 project, for example, from the front and rear edge portions of the paper-supply tray 44, and the sliding guide portions 78 are formed into a groove shape into which the sliding portions 77 fit. One of the two sliding portions 77 (the left sliding portion 77 in this example) on the front and rear of the paper-supply tray 44 is fixed to the belt 76. The belt 76 is driven in the direction of the arrow illustrated in FIG. 4A to raise the paper-supply tray 44, and the belt 76 is driven in the direction opposite to the arrow to lower the paper-supply tray 44.

[Control Unit]

The control unit 10 (see FIG. 5) may be realized by software using a processor, or may be realized by a logic circuit (hardware) formed in an integrated circuit or the like. In a case where a processor is used, the processor reads and executes a program stored in memory to execute various processes. As the processor, for example, a CPU (Central Processing Unit) is used. The memory includes a storage medium such as a ROM (Read Only Memory), a RAM (Random Access Memory), an EEPROM (Electrically Erasable Programmable Read Only Memory), or the like. The memory stores control programs used for controlling each unit of the multifunction peripheral 100

[Raising/Lowering Drive Amount Measuring Unit]

The raising/lowering mechanism 38 is provided with a raising/lowering drive amount measuring unit 12 (see FIG. 4A). The raising/lowering drive amount measuring unit 12 is, for example, an optical rotary encoder, and includes a light blocking plate 13, a photo interrupter 14, and a calculation unit 15. The light blocking plate 13 is a member in which a plurality of radially extending blades are formed on the edge of a disc at equal intervals (however, a wide interval only at the home position), and is provided on the drive pulley 74. The photo interrupter 14 is fixed to the second wall portion 42 and outputs a pulse signal the level of which is alternately changed by the rotation of the light blocking plate 13. The calculation unit 15 analyzes the pulse signal outputted from the photo interrupter 14 to calculate the rotation angle of the light blocking plate 13 (in other words, the rotation angle of the drive pulley 74), and outputs data indicating the calculated rotation angle to the control unit 10. The rotation angle of the drive pulley 74 is an amount indicating the drive amount of the raising/lowering mechanism 38. Note that the light blocking plate 13 may be provided on the output shaft of the motor that drives the drive pulley 74 or the follower pulley 75.

[Swing Drive Amount Measuring Unit]

The swing mechanism 37 is provided with a swing drive amount measuring unit 16 (see FIG. 3). The swing drive amount measuring unit 16 is, for example, an optical rotary encoder, and includes a light blocking plate 13, a photo interrupter 14, and a calculation unit 15 (the configuration is the same as that of the raising/lowering drive amount measuring unit 12, an illustration thereof is omitted). The light blocking plate 13 is provided on the cam shaft of the eccentric cam 72. The photo interrupter 14 is fixed to the bottom portion 40. The calculation unit 15 analyzes the pulse signal outputted from the photo interrupter 14 to calculate the rotation angle of the light blocking plate 13 (in other words, the rotation angle of the eccentric cam 72), and outputs data indicating the calculated rotation angle to the control unit 10. The rotation angle of the eccentric cam 72 is an amount indicating the drive amount of the swing mechanism 37. Note that the light blocking plate 13 may be provided on the output shaft of the motor that drives the eccentric cam 72.

[Upper Surface Height Measuring Unit]

The upper surface height measuring unit 19 (see FIG. 3) is located above the position of the discharge port 70 in the upper limit of the swingable range of the discharge mechanism 36 (the upper limit position illustrated in FIG. 9B) and arranged at a position corresponding to the central portion in the width direction of the document G and fixed to a bracket (not shown) protruding from the first wall portion 41 or the second wall portion 42. The upper surface height measuring unit 19 is, for example, a reflective photoelectric sensor, and includes a light emitting unit, a light receiving unit, and a calculation unit (not shown). The light emitting unit generates a pulse of light. The calculation unit calculates the time difference between light emission by the light emitting unit and light reception by the light receiving unit, or, based on the strength of the pulse of received light, calculates the distance between the upper surface height measuring unit 19 and the upper surface of the document G stacked on the discharge tray 43. In other words, this distance is the height of the upper surface of the document G based on the upper surface height measuring unit 19. The calculation unit outputs data indicating the calculated height to the control unit 10. Note that in a case where a document G is not stacked on the discharge tray 43, the calculation unit outputs data indicating the height of the upper surface of the discharge tray 43.

[Control of the Swing Mechanism]

The EEPROM provided in the control unit 10 has an LUT (Look-Look-up) in which the height of the upper surface of the document G stacked on the discharge tray 43, the drive amount of the swing mechanism 37, and the drive amount of the raising/lowering mechanism 38 are associated with each other is stored.

In a case where the difference in the discharge port 70 and the upper surface of a document G stacked on the discharge tray 43 (hereinafter referred to as the discharge difference) is too large, there is a possibility that a discharged document G will be scattered on the stacked documents G. On the other hand, in a case where the discharge difference is too small, the discharged document G and the stacked documents G may interfere with each other. In other words, the discharge difference has an appropriate range (an example of a specified range) in which a discharged document G is not scattered and a discharged document G does not interfere with the stacked documents G. In order for a document G to be normally discharged regardless of the amount of the documents G stacked on the discharge tray 43, the discharge difference needs to be maintained within an appropriate range.

Therefore, the control unit 10, by causing the swing mechanism 37 to swing the discharge mechanism 36 in accordance with the height measured by the upper surface height measuring unit 19, performs control so that the difference between the discharge port 70 and the upper surface of the documents G stacked on the discharge tray 43 is within a specified range. More specifically, the rotation angle of the eccentric cam 72 (the drive amount of the swing mechanism 37) and the height of the discharge port 70 have a monotonically increasing relationship, so the height of the discharge port 70 is uniquely determined according to the rotation angle of the eccentric cam 72. In the LUT, the rotation angle of the eccentric cam 72, which is calculated in advance so that the discharge difference falls within an appropriate range, is written in association with the height of the upper surface of the documents G. The control unit 10 reads the rotation angle of the eccentric cam 72 corresponding to the height measured by the upper surface height measuring unit 19 from the LUT, and performs feedback control of the swing mechanism 37 so that the rotation angle measured by the swing drive amount measuring unit 16 is equal to the rotation angle read from the LUT.

[Control of the Raising/Lowering Mechanism]

In a case where the reading of the documents G stacked on the paper-supply tray 44 is completed, the paper-supply tray 44 is lowered to form a space where the documents G can be stacked between the paper-supply tray 44 and the feeding roller 51; however, when the distance between the upper surface of the documents G stacked on the discharge tray 43 and the paper-supply tray 44 (hereinafter referred to as the paper-supply tray distance) becomes too small, there is a possibility that the discharged documents G and the paper-supply tray 44 will interfere with each other. Moreover, when the paper-supply tray 44 comes in contact with the upper surface of the documents G stacked on the discharge tray 43, there is no space for discharging the documents G. In other words, the paper-supply tray distance has a minimum value (an example of a specified distance) at which the paper-supply tray 44 does not interfere with the discharged documents G. In order for a document G to be properly discharged regardless of the amount of the documents G stacked on the discharge tray 43, the paper-supply tray distance needs to be maintained at a minimum value or more.

Therefore, in a case where no documents G are stacked on the paper-supply tray 44, the control unit 10, by causing the raising/lowering mechanism 38 to raise or lower the paper-supply tray 44 according to the height measured by the upper surface height measuring unit 19, performs control so that the distance between the upper surface of the documents stacked on the discharge tray 43 and the paper-supply tray 44 is a specified distance or more. More specifically, the rotation angle of the drive pulley 74 (the drive amount of the raising/lowering mechanism 38) and the raised/lowered amount of the paper-supply tray 44 are in a monotonically increasing relationship, so raising/lowering amount of the paper-supply tray 44 is uniquely determined according to the rotation angle of the drive pulley 74. The rotation angle of the drive pulley 74 calculated in advance so that the paper-supply tray distance becomes a specified distance is written in the LUT in association with the height of the upper surface of the documents G. The control unit 10 reads the rotation angle of the drive pulley 74 corresponding to the height measured by the upper surface height measuring unit 19 from the LUT, and performs feedback control of the raising/lowering mechanism 38 so that the rotation angle measured by the raising/lowering drive amount measuring unit 12 is equal to the rotation angle read from the LUT.

However, when the same control is performed in a case where the discharge mechanism 36 is located at the lower limit position, it is feasible that the paper-supply tray 44 may interfere with the discharge mechanism 36. Therefore, a lower limit value is set for the height of the paper-supply tray 44 so that the paper-supply tray 44 does not interfere with the discharge mechanism 36. In a case where the height of the paper-supply tray 44 obtained from the rotation angle of the drive pulley 74 reaches the lower limit value, the control unit 10 stops driving by the drive pulley 74 even when the paper-supply tray distance is greater than a specified distance.

[Paper-Supply Tray Document Detecting Unit]

A paper-supply tray document detecting unit 17 is provided on the upper surface of the paper-supply tray 44 (see FIGS. 2 and 3). The paper-supply tray document detecting unit 17 is, for example, a reflective photoelectric sensor, and includes a light emitting unit and a light receiving unit (not shown). When documents G are stacked on the paper-supply tray, the light emitted by the light emitting unit is reflected by the documents G, so the light receiving unit receives reflected light. When documents G are not stacked on the paper-supply tray, the light emitted from the light emitting unit is not reflected, and therefore the light receiving unit does not receive reflected light. The paper-supply tray document detecting unit 17 outputs signals to the control unit 10 having different levels depending on whether or not the light receiving unit receives reflected light. The control unit 10 determines the presence or absence of documents G on the paper-supply tray 44 based on the level of the signal.

[Feeding Roller Pressing Detecting Unit]

The feeding roller pressing detecting unit 21 includes a light blocking plate 22 provided on the upper portion of a holder 53, and a photo interrupter 23 provided on the inner surface of the cover portion 32. The photo interrupter 23 outputs signals to the control unit 10 having different levels depending on whether or not the light is blocked or not blocked by the light blocking plate 22. As described above, the holder 53 is supported by the drive shaft 54 and is able to swing centered around the drive shaft 54. The control unit 10 causes the raising/lowering mechanism 38 to raise the paper-supply tray 44 on which documents G are stacked, and by the upper surface of the documents G being pressed against the feeding roller 51, the holder 53 swings upward. In a case where the holder 53 swings upward by a specified amount, the light blocking plate 22 blocks the light from the photo interrupter 23. In this case, an appropriate load acts between the upper surface of the documents G and the feeding roller 51, and the feeding roller 51 is able to feed the documents G.

The position of the holder 53 at this time is called a pressing position.

[Operation of the Document Conveying Apparatus]

Figure 6:
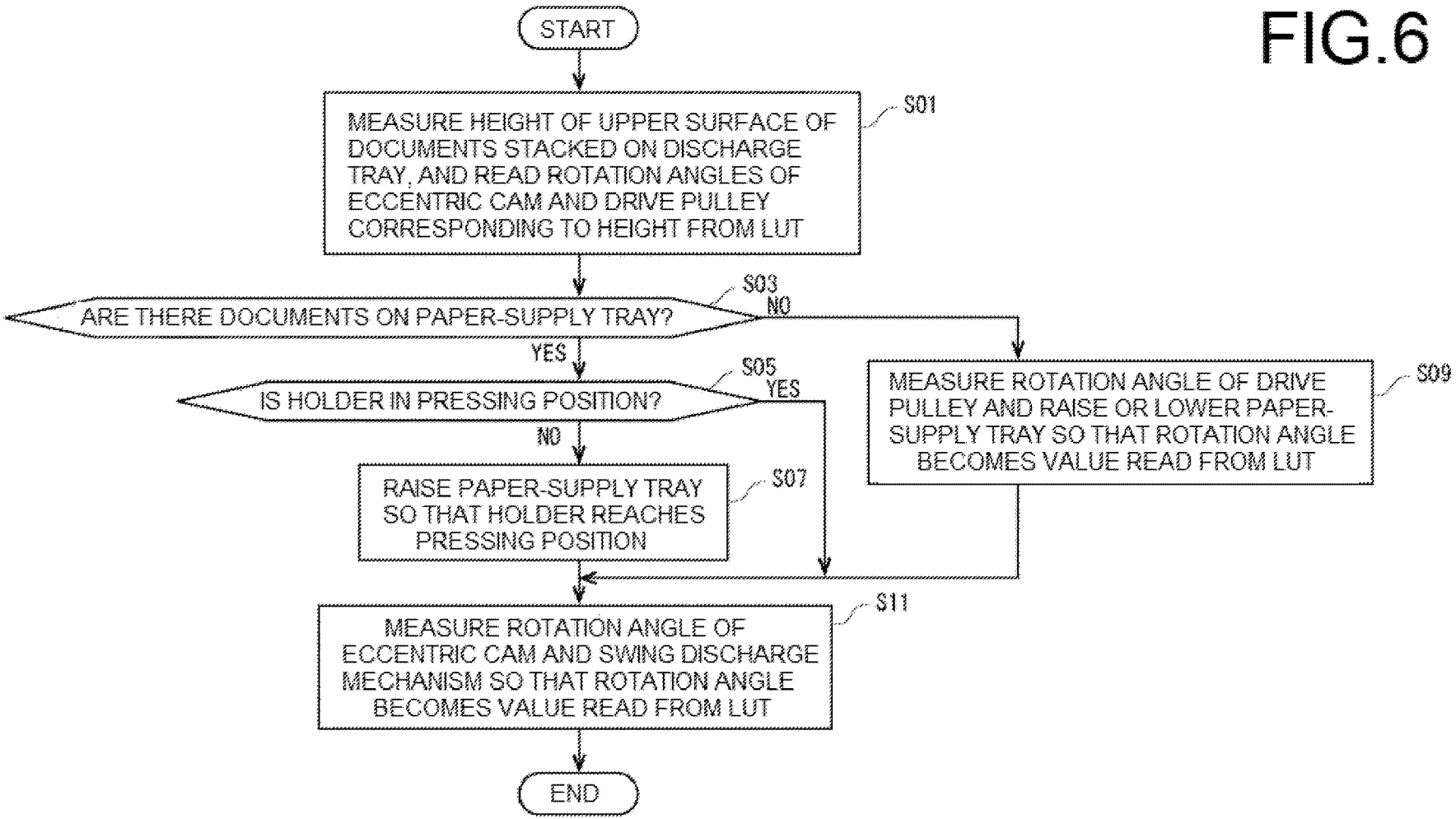
FIG. 6 is a flowchart illustrating a procedure of height control executed by a control unit of the first embodiment and the second embodiment according to the present disclosure.

Next, with reference to FIG. 6, the height control of the document conveying apparatus 9 will be described. FIG. 6 is a flowchart illustrating the procedure of height control executed by the control unit 10. When the power supply to the printer 1 is turned ON, the control unit 10 repeatedly executes the height control illustrated in FIG. 6.

First, the control unit 10 causes the upper surface height measuring unit 19 to measure the height of the upper surface of the document G stacked on the discharge tray 43, and reads the rotation angles of the eccentric cam 72 and the drive pulley 74 corresponding to the height of the upper surface from the LUT (step S01).

Next, the control unit 10 determines from the output signal of the paper-supply tray document detecting unit 17 whether or not there are documents G on the paper-supply tray 44 (step S03).

In a case where it is determined that there are documents G present on the paper-supply tray 44 (step S03: YES), the control unit 10 shifts to the processing of step S05, and based on the output signal of the feeding roller pressing detecting unit 21, determines whether or not the holder 53 of the feeding mechanism 34 is located at the pressing position. When it is determined that the holder 53 is located at the pressing position (step S05: YES), the control unit 10 proceeds to the processing of step S11. On the other hand, when it is determined that the holder 53 is not located at the pressing position (step S05: NO), the control unit 10 proceeds to the processing of step S07 and causes the raising/lowering mechanism 38 to raise the paper-supply tray 44 so that the holder 53 reaches the pressing position.

On the other hand, when it is determined that there are no documents G on the paper-supply tray 44 (step S03: NO), the control unit 10 moves to the processing of step S09, causes the raising/lowering drive amount measuring unit 12 to measure the rotation angle of the drive pulley 74, and causes the raising/lowering mechanism 38 to lower the paper-supply tray 44 so that the measured rotation angle equals to the value read from the LUT. With this operation, the paper-supply tray distance is adjusted to the minimum value at which the paper-supply tray 44 does not interfere with the discharged documents G and the discharge mechanism 36. In addition, a space in which documents G may be stacked is formed between the paper-supply tray 44 and the feeding roller 51.

Following step S07 or step S09, the control unit 10 causes the swing drive amount measuring unit 16 to measure the rotation angle of the eccentric cam 72, and causes the swing mechanism 37 to swing the discharge mechanism 36 so that the measured rotation angle becomes equal to the value read from the LUT (step S11). With this operation, the discharge difference is adjusted to an appropriate range in which the discharged documents G are not scattered and the discharged documents G do not interfere with the stacked documents G. Note that step S11 may be executed between step S01 and step S03.

Next, the operation of the document conveying apparatus 9 when documents G are stacked on the paper-supply tray 44 will be described with reference to FIGS. 6 to 9B. FIGS. 7A to 9B are cross-sectional views illustrating the operation of the document conveying apparatus 9.

Figure 7A:
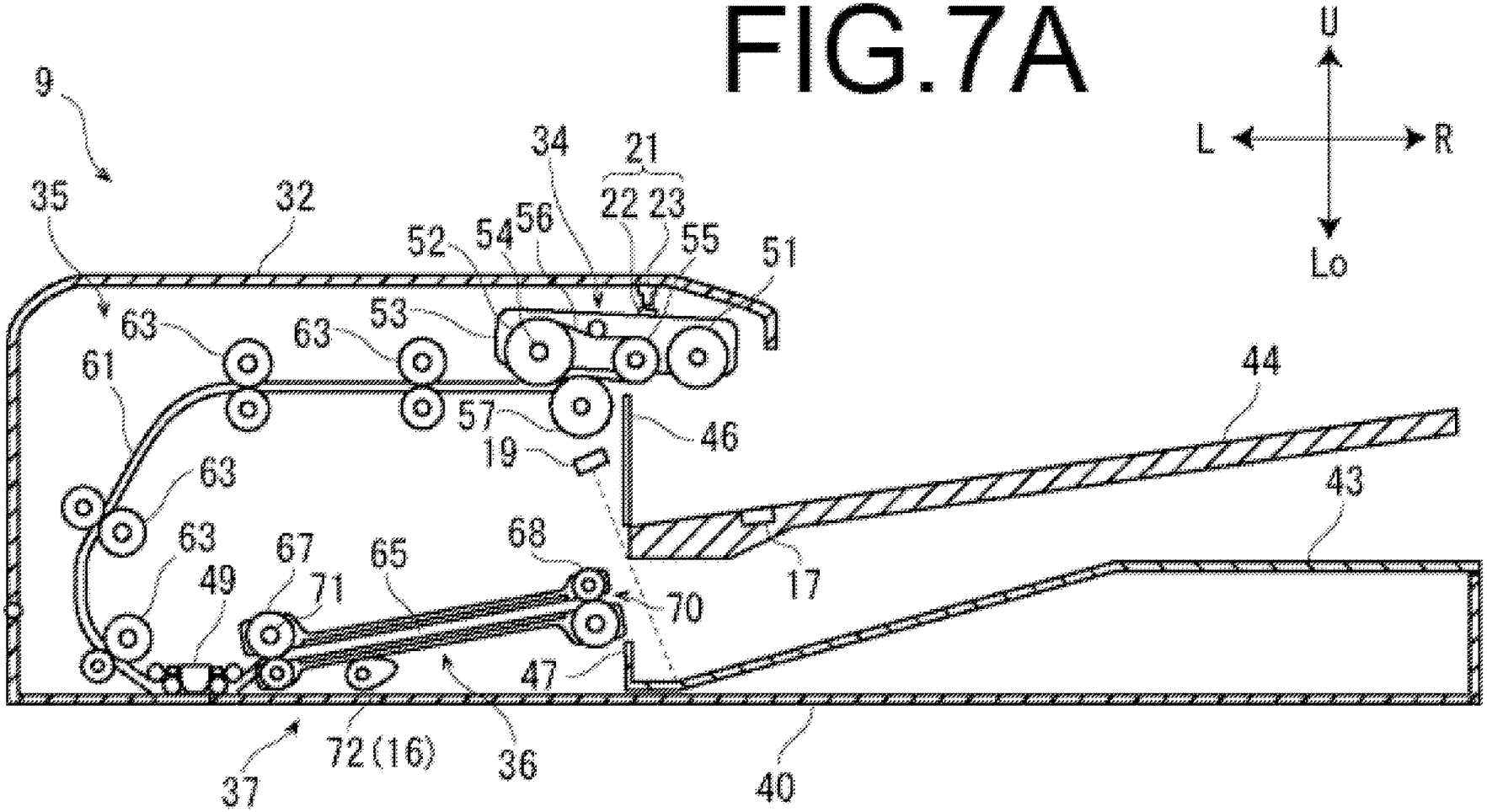
FIG. 7A is a cross-sectional view illustrating an operation of the document conveying apparatus of the first embodiment and the second embodiment according to the present disclosure.

FIG. 7A illustrates a state before documents G are stacked on the paper-supply tray 44 and the discharge tray 43. In this case, in step S01, the control unit 10 causes the upper surface height measuring unit 19 to measure the height of the upper surface of the discharge tray 43, and reads the rotation angles of the eccentric cam 72 and the drive pulley 74 corresponding to this height from the LUT; in step S03, determines that there are no documents G on the paper-supply tray 44 (step S03: NO); in step S09, causes the raising/lowering mechanism 38 to position the paper-supply tray 44 at the lower limit position of the possible raising/lowering range; and in step S11, causes the swing mechanism 37 to position the discharge mechanism 36 at the lower limit position of the swingable range.

Figure 7B:
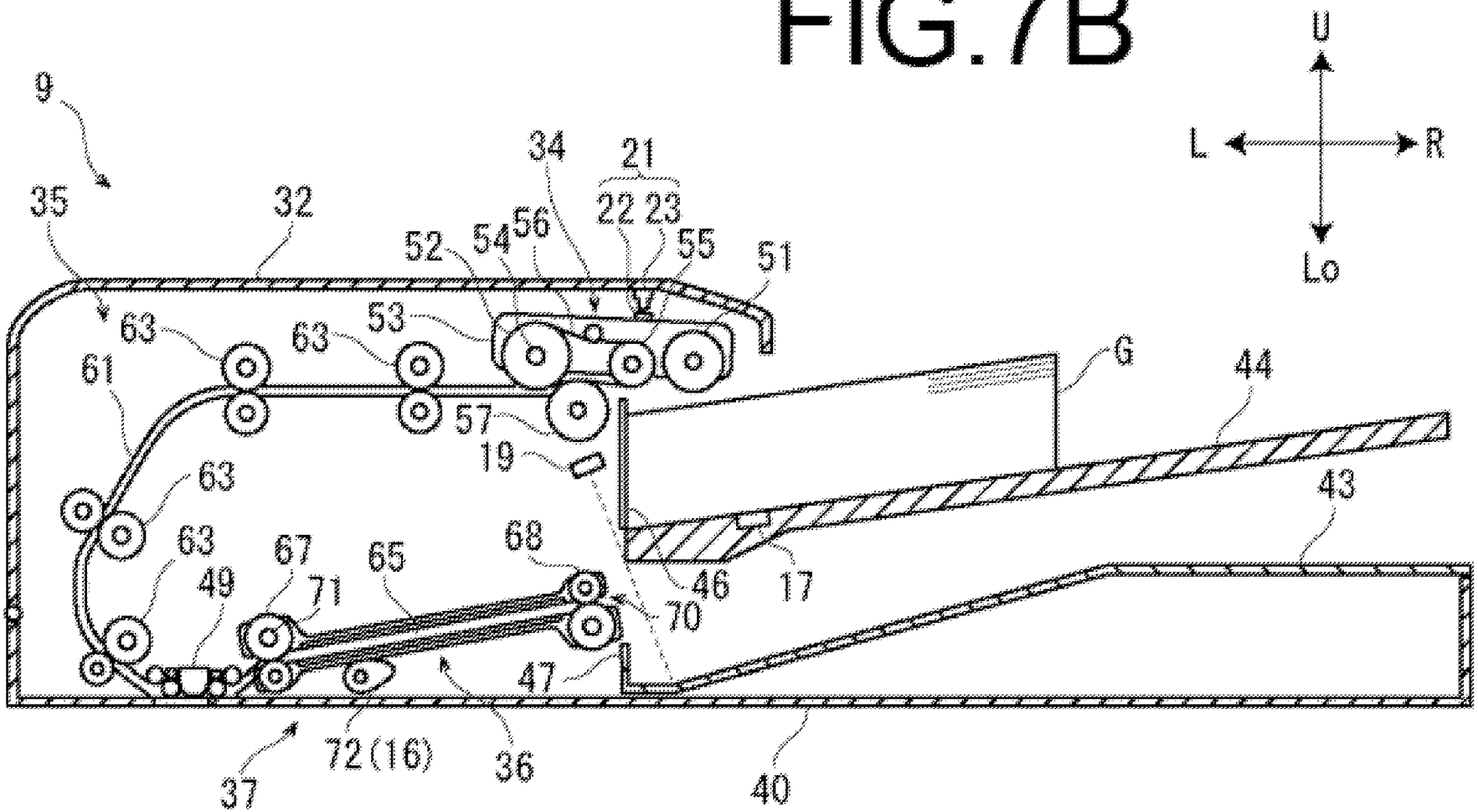
FIG. 7B is a cross-sectional view illustrating the operation of the document conveying apparatus of the first embodiment and the second embodiment according to the present disclosure.

FIG. 7B illustrates a state in which documents G are stacked on the paper-supply tray 44. In this case, in step S01, the control unit 10 causes the upper surface height measuring unit 19 to measure the height of the upper surface of the discharge tray 43, and reads the rotation angles of the eccentric cam 72 and the drive pulley 74 corresponding to this height from the LUT; in step S03, determines that there are documents G on the paper-supply tray 44 (step S03: YES); in step S05, determines that the holder 53 is not located at the pressing position (step S05: NO); and in step S07, causes the raising/lowering mechanism 38 to raise the paper-supply tray 44 so that the holder 53 reaches the pressing position. In step S11, the position of the discharge mechanism 36 is at the lower limit position of the swingable range and does not change (see FIG. 8A).

When an instruction to start reading is inputted in a state in which the holder 53 is positioned at the pressing position, the control unit 10 starts a reading job by causing the feeding mechanism 34 to feed documents G one sheet at a time to the conveying path 61, and causing the scanner 8 to read the documents G. The control unit 10 repeatedly executes height control in parallel with the reading job. In this case, in step S01, the control unit 10 causes the upper surface height measuring unit 19 to measure the height of the upper surface of the documents G stacked on the discharge tray 43 and reads the rotation angles of the eccentric cam 72 and the drive pulley 74 corresponding to this height from the LUT, and in step S03, determines there are documents G on the paper-supply tray 44 (step S03: YES).

Figure 8A:
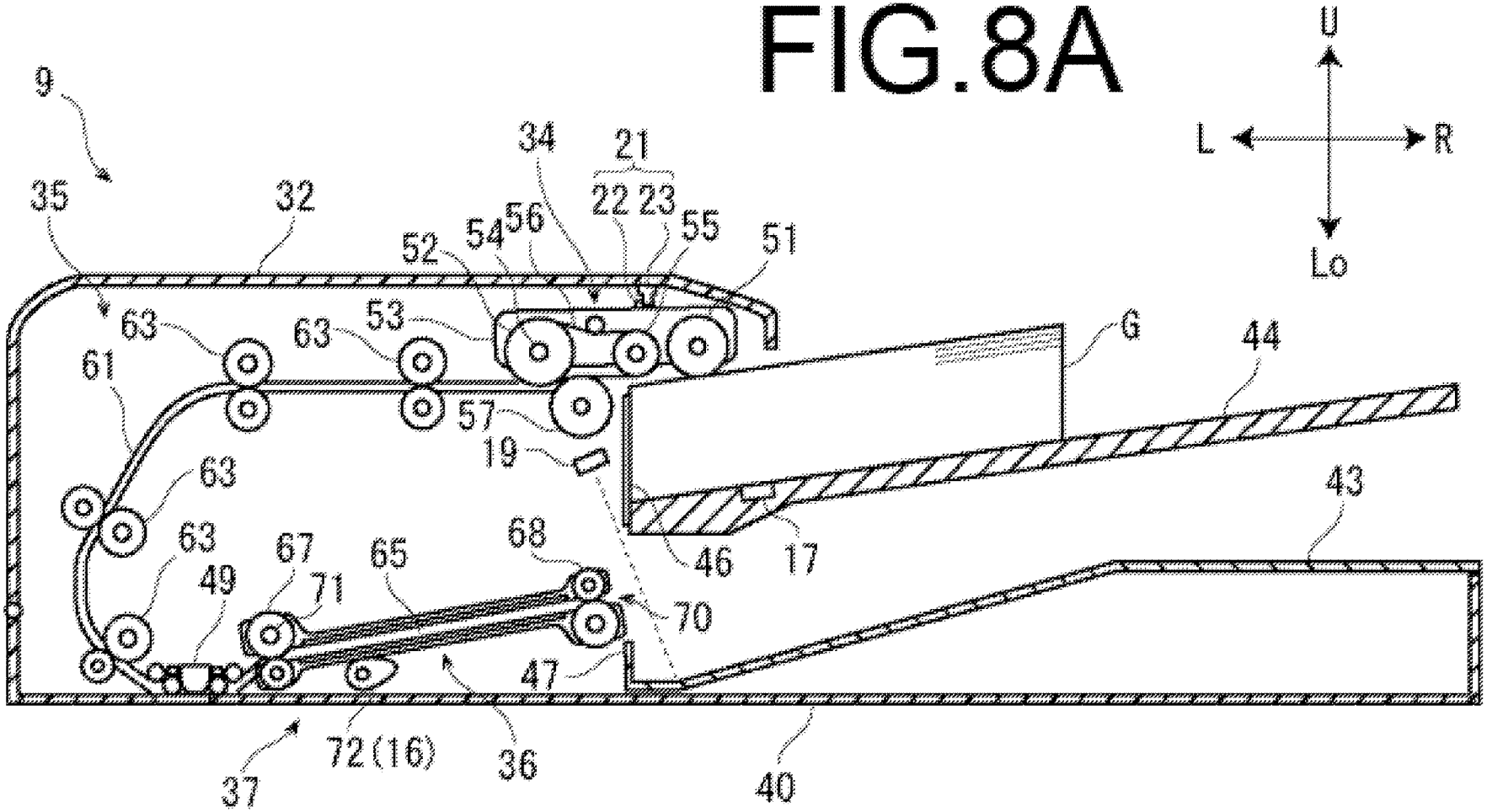
FIG. 8A is a cross-sectional view illustrating the operation of the document conveying apparatus of the first embodiment and the second embodiment according to the present disclosure.
Figure 8B:
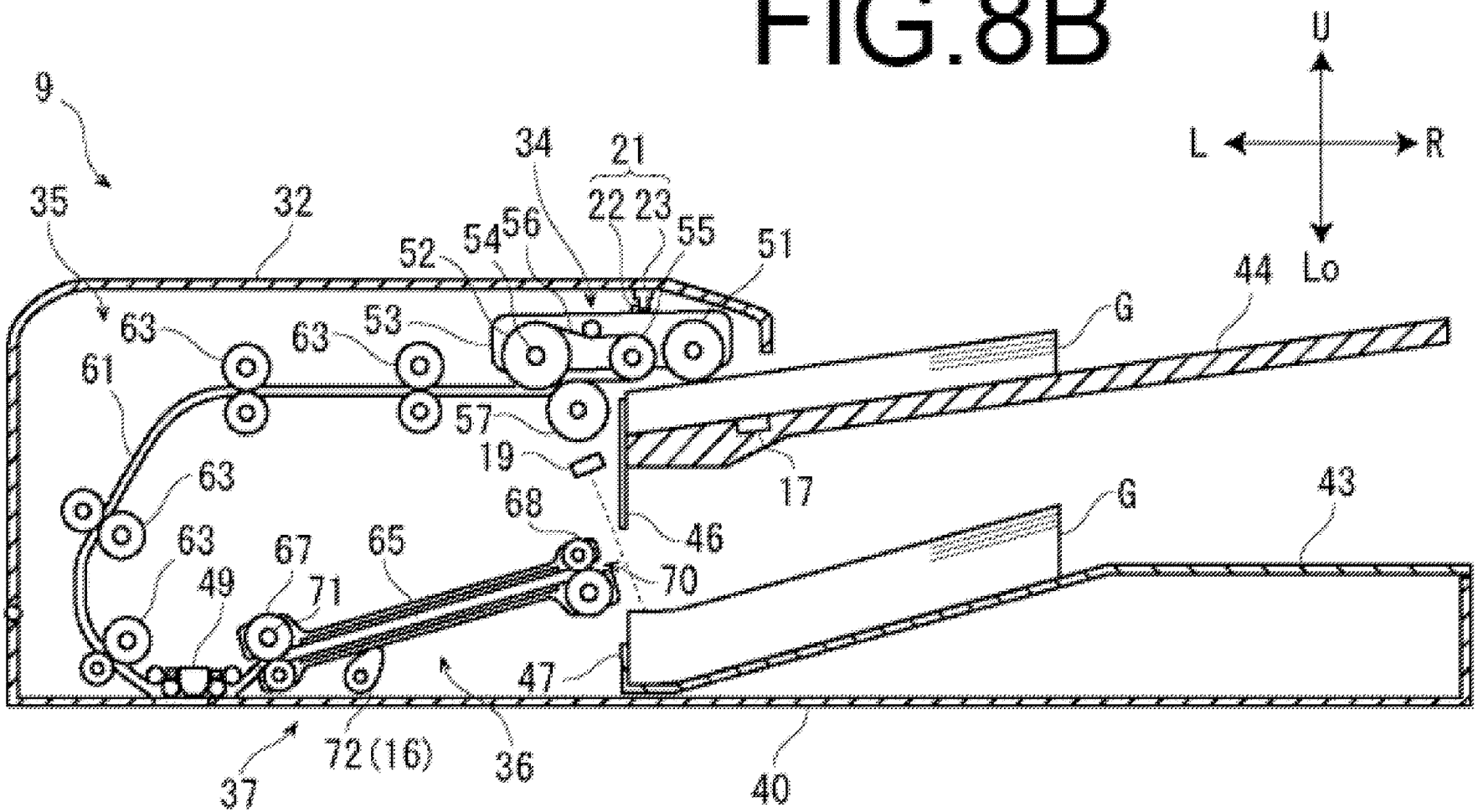
FIG. 8B is a cross-sectional view illustrating the operation of the document conveying apparatus of the first embodiment and the second embodiment according to the present disclosure.

As the documents G are fed out, the height of the upper surface of the documents G stacked on the paper-supply tray 44 becomes lower, so the holder 53 swings downward. In a case where the holder 53 swings below the pressing position and the level of the signal outputted from the feeding roller pressing detecting unit 21 switches, the control unit 10 determines that the holder 53 is not located at the pressing position (step S05: NO), and in step S07, the control unit 10 causes the raising/lowering mechanism 38 to raise the paper-supply tray 44 so that the holder 53 reaches the pressing position, and restores the condition to a state in which the upper surface of the documents G stacked on the paper-supply tray 44 is pressed against the feeding roller 51. Then, in step S11, the control unit 10 causes the swing mechanism 37 to swing the discharge mechanism 36 upward. By this operation, the discharge difference is adjusted to an appropriate range. As an example, FIG. 8B illustrates a state in which approximately two-thirds of the documents G stacked on the paper-supply tray 44 have been read.

Figure 9A:
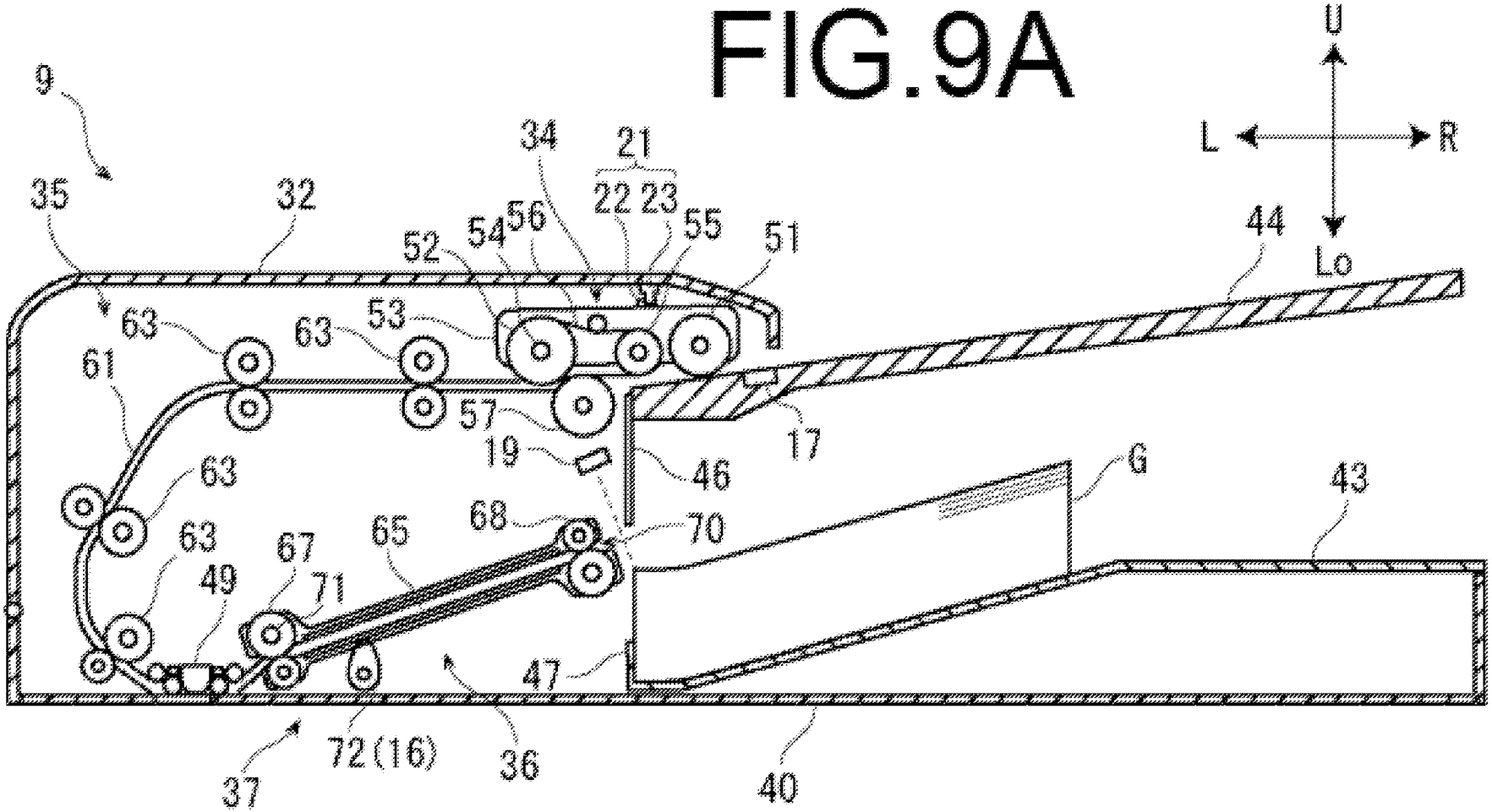
FIG. 9A is a cross-sectional view illustrating the operation of the document conveying apparatus of the first embodiment and the second embodiment according to the present disclosure.
Figure 9B:
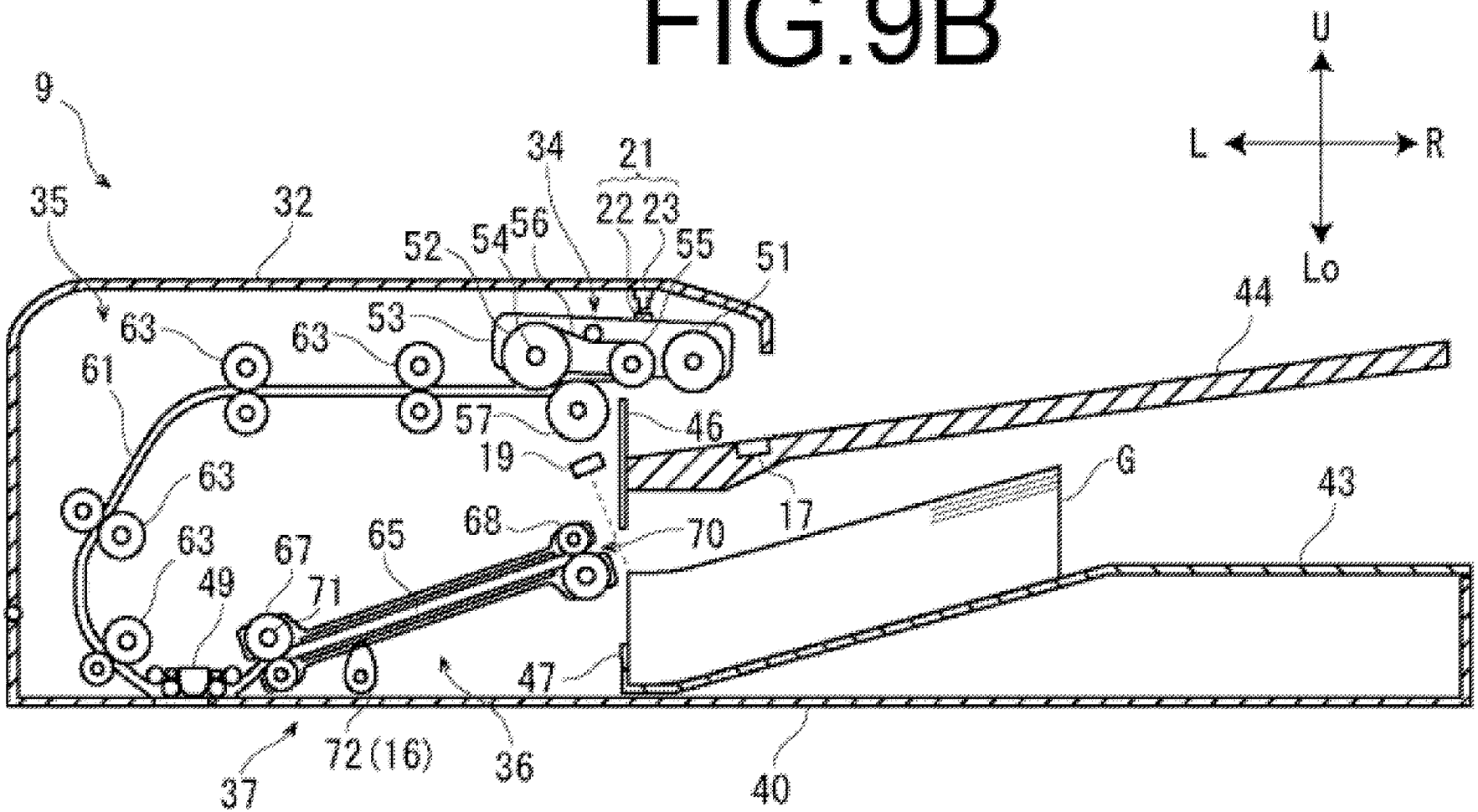
FIG. 9B is a cross-sectional view illustrating the operation of the document conveying apparatus of the first embodiment and the second embodiment according to the present disclosure.

FIG. 9A illustrates a state in which all of the documents G have been read. In this case, in step S01, the control unit 10 causes the upper surface height measuring unit 19 to measure the height of the upper surface of the documents G stacked on the discharge tray 43, and reads the rotations angles of the eccentric cam 72 and the drive pulley 74 corresponding to this height from the LUT, and then in step S03, determines that there are no documents G on the paper-supply tray 44 (step S03: NO), and in step S09, causes the raising/lowering mechanism 38 to lower the paper-supply tray 44. In this case, there are documents G stacked on the discharge tray 43, so the paper-supply tray distance is adjusted to the minimum value. In addition, a space in which documents G may be stacked is formed between the paper-supply tray 44 and the feeding roller 51. Then, in step S11, the control unit 10 causes the swing mechanism 37 to swing the discharge mechanism 36 upward. By this operation, the discharge difference is adjusted to an appropriate range (see FIG. 9B).

In a case where documents stacked on the discharge tray 43 have been removed, in step S01, the control unit 10 causes the upper surface height measuring unit 19 to measure the height of the upper surface of the discharge tray 43, and reads the rotation angles of the eccentric cam 72 and the drive pulley 74 corresponding to this height from the LUT; in step S03, determines that there are no documents G on the paper-supply tray 44 (step S03: NO); in step S09, causes the raising/lowering mechanism 38 to position the paper-supply tray 44 at the lower limit position of the possible raising/lowering range; and in step S11, causes the swing mechanism 37 to position the discharge mechanism 36 at the lower limit position of the swingable range (see FIG. 7A).

In a document feeding apparatus proposed in by a typical technique, in a case where a small amount of documents are stacked on the paper-supply tray, the difference from the discharge port to the upper surface of the discharge tray becomes large, so there is a possibility that the discharged documents will become scattered on the discharge tray. In addition, in a case where subsequent reading is performed with a large amount of documents stacked on the discharge tray, the succeeding documents may interfere with the documents stacked on the discharge tray or the paper-supply tray. Moreover, in a case where a large amount of documents have been read, the paper-supply tray that has been lowered after reading is completed may come into contact with the upper surface of the documents. To solve these problems, configuration is conceivable in which the discharge port is raised or lowered separately from the paper-supply tray. However, a conveying roller and a transmission mechanism for transmitting a driving force to the conveying roller from a drive source are provided on the conveying path near the discharge port. In order to raise and lower the discharge port it is also necessary to raise and lower the conveying roller together with the discharge port, so there is a problem in that the transmission mechanism inevitably becomes complicated and the cost is increased.

In consideration of the above circumstances, the object of the technique according to the present disclosure is to provide document a document conveying apparatus and a document reading apparatus capable of normally discharging documents regardless of the amount of documents stacked on a discharge tray without complicating a transmission mechanism for transmitting a driving force to a conveying roller.

With the document conveying apparatus 9 according to the present embodiment described above, the control unit 10 causes swing mechanism 37 to swing the discharge mechanism 36 according to a height measured by the upper surface height measuring unit 19, and thus controls a difference between the discharge port 70 and the upper surface of documents G stacked on the discharge tray 43 so as to be within a specified range, and thus it is possible to properly discharge documents G regardless of the amount of documents G stacked on the discharge tray 43. Moreover, with the document conveying apparatus 9 according to the present embodiment, the swing mechanism 37 is caused to swing the discharge mechanism 36 centered around the drive shaft 67*c* of the conveying roller pair 67, so compared with the case of swinging the discharge mechanism 36 centered around a shaft that is provided separately from the drive shaft 67*c* of the conveying roller pair 67, it is possible to avoid complicated construction of the transmission mechanism for transmitting a driving force to the drive shaft 67*c*. Therefore, with the document conveying apparatus 9 according to the present embodiment, the documents G may be properly stacked without complicated construction of a transmission mechanism for transmitting a driving force to the conveying roller pair 67 regardless of the amount of documents G stacked on the discharge tray 43.

In other words, according to the present embodiment, it is possible to properly discharge documents without complicated construction of a transmission mechanism for transmitting a driving force to conveying rollers regardless of the amount of documents stacked on a discharge tray.

Furthermore, with the document conveying apparatus 9 according to the present embodiment, a transmission mechanism 64 is provided for transmitting the driving force from the drive shaft 67*c* of the conveying roller pair 67 to a discharge roller pair 68, so there is no need to provide a drive source dedicated to the discharge roller pair 68, and thus it is possible to avoid complicated construction.

Furthermore, with the document conveying apparatus 9 according to this embodiment, in a case where documents G are not stacked on the paper-supply tray 44, the control unit 10 is able to cause the raising/lowering mechanism 38 to raise or lower the paper-supply tray 44 according to the height measured by the upper surface height measuring unit 19, whereby the control unit 10 performs control so that the distance between the upper surface of the documents G stacked on the discharge tray 43 and the paper-supply tray 44 is equal to or greater than a specified distance. Therefore, with the document conveying apparatus 9 according to the present embodiment, it is possible to prevent the paper-supply tray 44 from interfering with the discharged documents G and the discharge mechanism 36.

The above embodiment may be modified as follows.

In the embodiment described above, an example in which the transmission mechanism 64 includes the drive pulley 67*d*, the follower pulley 68*d*, and the belt 64*a* is given;

however, instead of this configuration, the transmission mechanism 64 may include a gear train.

In addition to the configuration of the embodiment described above, configuration is possible in which in a case where the height of the upper surface of the documents G stacked on the discharge tray 43 do not raise even though the documents G are fed out by the feeding roller 51, the control unit 10 may stop feeding of the documents G by the feeding roller 51. With this configuration, in a case where a document G is clogged in the conveying path 61 or the discharge path 65, the document G can be quickly removed.

In addition to the configuration of the embodiment described above, configuration may be such that in a case where the height of the upper surface of the documents G stacked on the discharge tray 43 is equal to or higher than a threshold value, the control unit 10 may stop the feeding of the documents G by the feeding roller 51. With this configuration, it is possible to prevent the documents G stacked on the discharge tray 43 and the discharged documents G from interfering with each other.

In the embodiment described above, an example of the swing mechanism 37 by the cam mechanism is given; however, instead of this, a solenoid actuator, a rack and pinion, a ball screw, a linear motor, a belt drive, or the like may be used.

In the embodiment described above, an example of the raising/lowering mechanism 38 by a belt drive is given; however, instead of this, a solenoid actuator, a rack and pinion, a ball screw, a linear motor, a cam mechanism, or the like may be used.

The motor that drives the eccentric cam 72 of the swing mechanism 37 may be a stepping motor. In this case, by using the number of drive pulses of the stepping motor as the drive amount of the swing mechanism 37, the swing drive amount measuring unit 16 may be omitted.

The motor that drives the drive pulley 74 of the raising/lowering mechanism 38 may be a stepping motor. In this case, by using the number of drive pulses of the stepping motor as the drive amount of the raising/lowering mechanism 38, the raising/lowering drive amount measuring unit 12 may be omitted.

Second Embodiment

In a document feeding apparatus proposed in by a typical technique, in a case where a small amount of documents are stacked on the paper-supply tray, the difference from the discharge port to the upper surface of the discharge tray becomes large, so there is a possibility that the discharged documents will become scattered on the discharge tray. In addition, in a case where subsequent reading is performed with a large amount of documents stacked on the discharge tray, the succeeding documents may interfere with the documents stacked on the discharge tray or the paper-supply tray. Moreover, in a case where a large amount of documents have been read, the paper-supply tray that has been lowered after reading is completed may come into contact with the upper surface of the documents.

In consideration of the above circumstances, an object of the present embodiment is to provide a document conveying apparatus and a document reading apparatus capable of normally discharging documents regardless of the amount of documents stacked on a discharge tray.

The document conveying apparatus 9 of the present embodiment includes: a paper-supply tray 44 on which the documents G are stacked; a discharge tray 43 provided below the paper-supply tray 44; a feeding roller 51 for feeding the documents G one sheet at a time from the paper-supply tray 44; a conveying mechanism 35 that conveys the fed documents G along the conveying path 61 via the reading position; a discharge mechanism 36 that conveys the documents G along a discharge path 65 connected to the conveying path 61 and discharges the documents G to a discharge tray 43 from a discharge port 70 provided at an end portion of the discharge path 65 on the downstream side in the conveying direction; a swing mechanism 37 at an end portion on the upstream side in the conveying direction of the discharge path 65 and including a swing shaft 71, the axial direction of which is the width direction of the documents G orthogonal to the conveying direction, and that swings the discharge mechanism 36 centered around the swing shaft 71; a raising/lowering mechanism 38 that raises or lowers the paper-supply tray 44 so that the upper surface of a document G stacked on the paper-supply tray 44 is pressed against the feeding roller 51; an upper surface height measuring unit 19 that is provided further above the position of the discharge port 70 at the upper limit of the swingable range of the discharge mechanism 36 and that measures the height of the top surface of the document G loaded on the discharge tray 43; and a control unit 10 that, by causing the swing mechanism 37 to swing the discharge mechanism 36 according to the height measured by the upper surface height measuring unit 19, controls the difference between the discharge port 70 and the upper surface of the document G stacked on the discharge tray 43 so as to be within a specified range.

[Discharge Mechanism]

In the present embodiment, the conveying roller pair 67 and the discharge roller pair 68 are supported by roller support portions 69 formed vertically at both the front and rear end portions of the discharge guide members 66. The conveying roller pair 67 and discharge roller pair 68 each include a driving roller and a follower roller, and the driving roller is connected to a drive source (not illustrated) such as a motor or the like. A discharge port 70 through which the documents G are discharged is formed in a contact region between the driving roller and the follower roller of the discharge roller pair 68.

[Swing Mechanism]

The swing mechanism 37 includes a swing shaft 71 and an eccentric cam 72. The swing shaft 71 is provided at the end portion on the upstream side in the conveying direction of the discharge path 65 with the front-rear direction as the axial direction. In the present embodiment, the drive shaft of the transport roller pair 67 also serves as the swing shaft 71, but the follower shaft of the conveying roller pair 67 may also serve as the swing shaft 71, a swing shaft 71 different from the drive shaft and the follower shaft of the conveying roller pair 67 may be provided on the discharge guide member 66. The eccentric cam 72 is able to swing centered around a cam shaft whose axial direction is the front-rear direction, and is connected to a drive source (not illustrated) such as a motor or the like. A sliding surface of the eccentric cam 72 comes in contact with a lower surface of the lower discharge guide members 66. Swinging of the eccentric cam 72 causes the discharge mechanism 36 to swing centered around the swing shaft 71.

With the document conveying apparatus 9 according to the present embodiment described above, the control unit 10, by causing the swing mechanism 37 to swing the discharge mechanism 36 according to the height measured by the upper surface height measuring unit 19, performs control so that the difference between the discharge port 70 and the upper surface of the documents G stacked on the discharge tray 43 are within a specified range. Therefore, with the document conveying apparatus 9 according to the present embodiment, documents G may be properly discharged regardless of the amount of documents G stacked on the discharge tray 43.

Furthermore, with the document conveying apparatus 9 according to this embodiment, in a case where documents G are not stacked on the paper-supply tray 44, the control unit 10 is able to cause the raising/lowering mechanism 38 to raise or lower the paper-supply tray 44 according to the height measured by the upper surface height measuring unit 19, whereby the control unit 10 performs control so that the distance between the upper surface of the documents G stacked on the discharge tray 43 and the paper-supply tray 44 is equal to or greater than a specified distance. Therefore, with the document conveying apparatus 9 according to the present embodiment, it is possible to prevent the paper-supply tray 44 from interfering with the discharged documents G and the discharge mechanism 36.

With this embodiment, it is possible to properly discharge documents regardless of the amount of documents stacked on the discharge tray.

Third Embodiment

Figure 11:
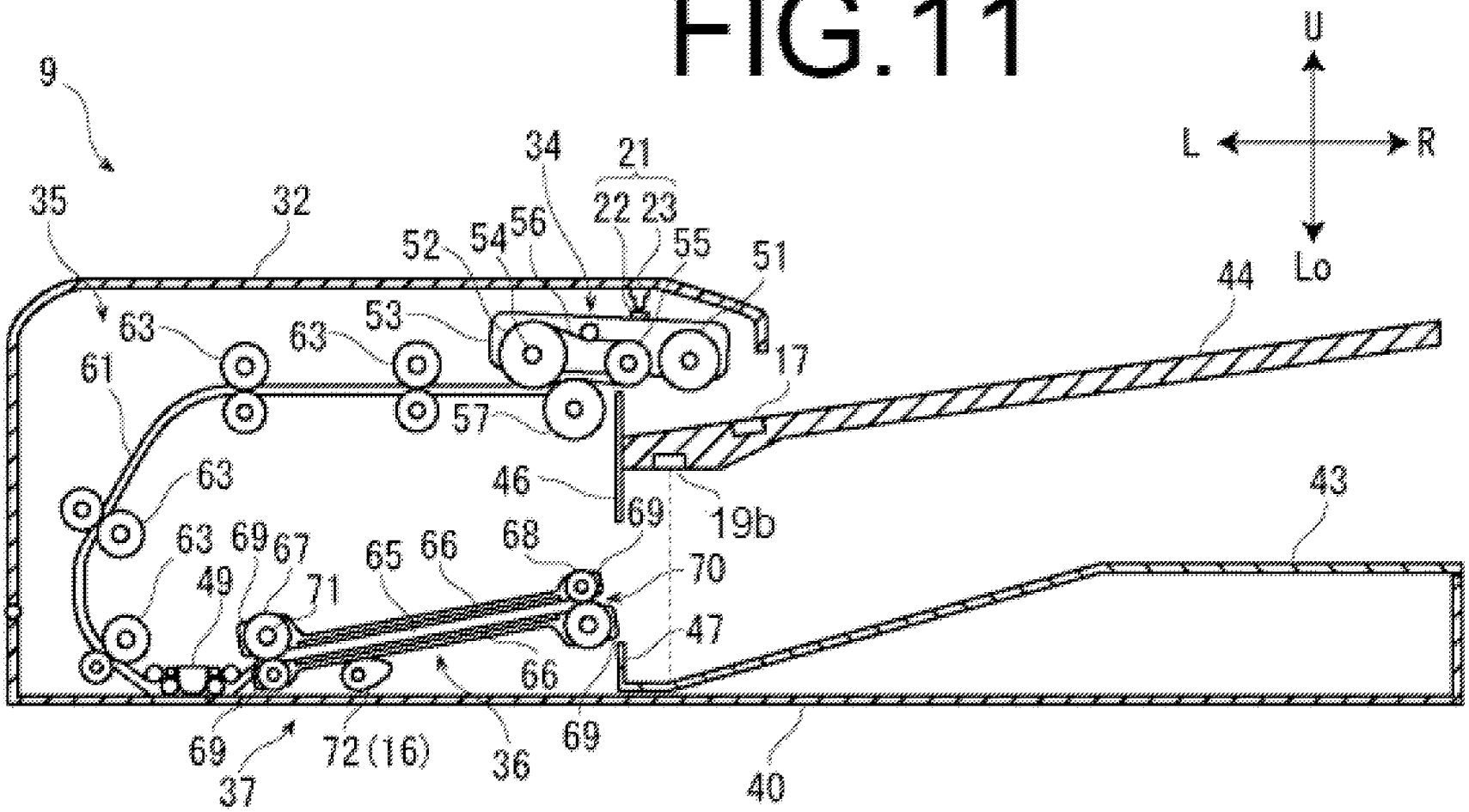
FIG. 11 is a cross-sectional view of a document conveying apparatus of a third embodiment according to the present disclosure.
Figure 12:
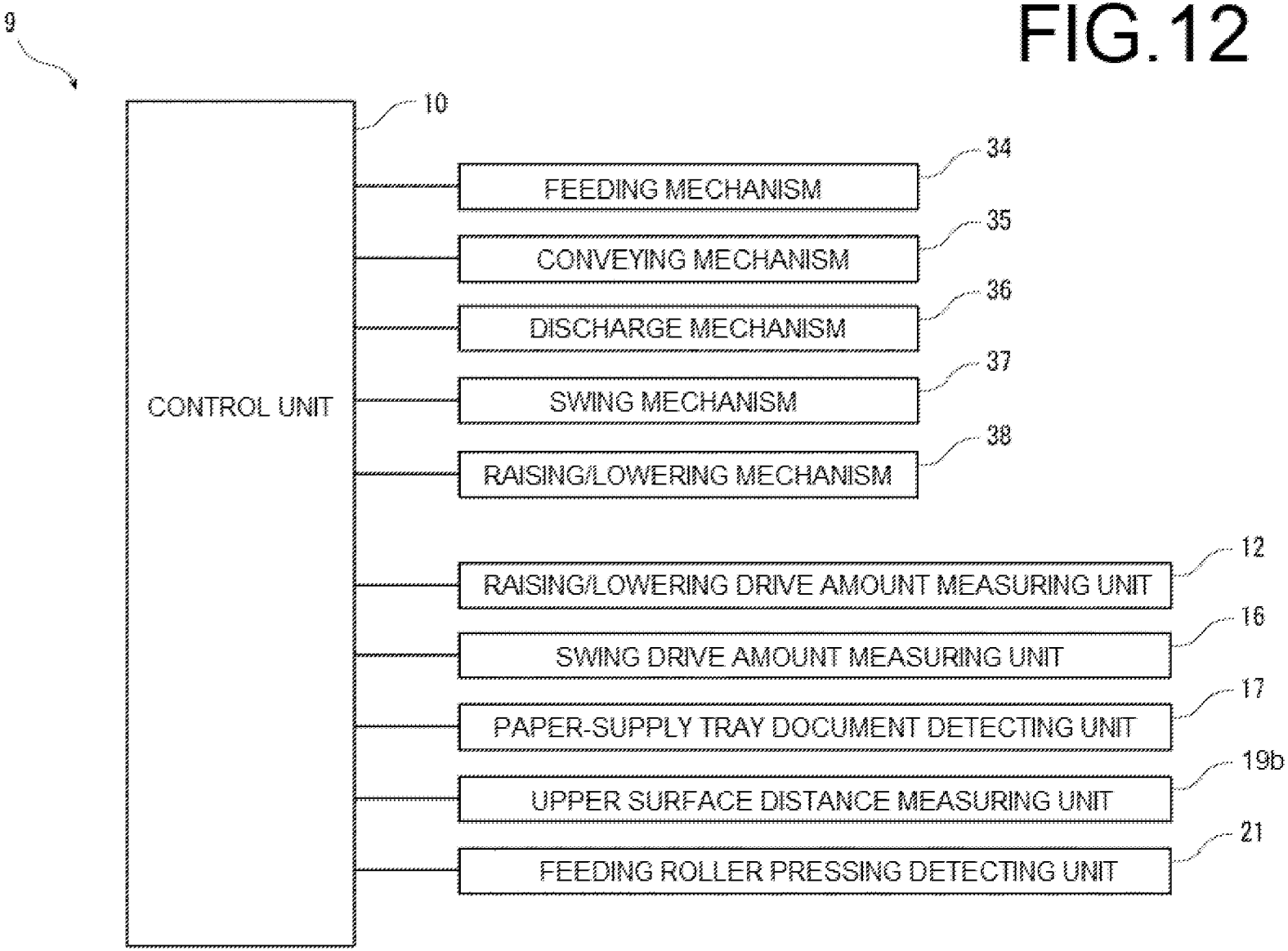
FIG. 12 is a block diagram illustrating the electrical configuration of the document conveying apparatus of the third embodiment according to the present disclosure.

In addition to the above drawings, a configuration of a document conveying apparatus 9 according to the present embodiment will be described with reference to FIGS. 11 and 12.

The document conveying apparatus 9 includes: a paper-supply tray 44 on which the documents G are stacked; a discharge tray 43 provided below the paper-supply tray 44; a feeding roller 51 for feeding the documents G one sheet at a time from the paper-supply tray 44; a conveying mechanism 35 that conveys the fed documents G along the conveying path 61 via the reading position; a discharge mechanism 36 that conveys the documents G along a discharge path 65 connected to the conveying path 61 and discharges the documents G to a discharge tray 43 from a discharge port 70 provided at an end portion of the discharge path 65 on the downstream side in the conveying direction; a swing mechanism 37 at an end portion on the upstream side in the conveying direction of the discharge path 65 and including a swing shaft 71, the axial direction of which is the width direction of the documents G orthogonal to the conveying direction, and that swings the discharge mechanism 36 centered around the swing shaft 71; a raising/lowering mechanism 38 that raises or lowers the paper-supply tray 44 so that the upper surface of a document G stacked on the paper-supply tray 44 is pressed against the feeding roller 51; an upper surface distance measuring unit 19*b* provided on the lower surface of the paper-supply tray 44 and that measures the distance from the upper surface of the documents G stacked on the discharge tray 43; and control unit 10 that calculates the height of the upper surface of the documents G stacked on the discharge tray 43 based on the distance measured by the upper surface distance measuring unit 19*b* and the height of the paper-supply tray 44 obtained from the driving amount of the raising/lowering mechanism 38, and by causing the swing mechanism 37 to swing the discharge mechanism 36 according to the calculated height, performs control so that the difference between the discharge port 70 and the upper surface of the documents G stacked on the discharge tray 43 is within a specified range.

[Upper Surface Distance Measuring Unit]

The upper surface distance measuring unit 19*b* (see FIG. 11) of the present embodiment is fixed to the lower surface of the paper-supply tray 44. The upper surface distance measuring unit 19*b* is, for example, a reflective photoelectric sensor, and includes a light emitting unit, a light receiving unit, and a calculation unit. The light emitting unit generates a pulse of light. The calculation unit calculates the distance between the upper surface distance measuring unit 19*b* and the upper surface of the documents G stacked on the discharge tray 43 based on the time difference between the light emitted by the light emitting unit and the light received by the light receiving unit or based on the strength of the received light pulse, and outputs data indicating the calculated distance to the control unit 10. Note that in a case where documents G are not stacked on the discharge tray 43, the calculation unit outputs data indicating the distance to the upper surface of the discharge tray 43.

[Control of the Swing Mechanism]

In the present embodiment, by calculating the height of the upper surface of the documents G stacked on the discharge tray 43 based on the distance measured by the upper surface distance measuring unit 19*b* and the height of the paper-supply tray 44 obtained from the driving amount of the raising/lowering mechanism 38 and causing the swing mechanism 37 to swing the discharge mechanism 36 according to the calculated height, the control unit 10 performs control so that the difference between the discharge port 70 and the upper surface of the documents G stacked on the discharge tray 43 is within a specified range. More specifically, the rotation angle of the eccentric cam 72 (the drive amount of the swing mechanism 37) and the height of the discharge port 70 have a monotonically increasing relationship, so the height of the discharge port 70 is uniquely determined according to the rotation angle of the eccentric cam 72. In the LUT, the rotation angle of the eccentric cam 72, which is calculated in advance so that the discharge difference falls within an appropriate range, is written in association with the height of the upper surface of the documents G. Moreover, since the rotation angle of the drive pulley 74 (the drive amount of the raising/lowering mechanism 38) and the height of the paper-supply tray 44 are in a monotonously increasing relationship, the height of the paper-supply tray 44 can be obtained from the rotation angle of the drive pulley 74. The control unit 10 calculates the height of the upper surface of the documents G stacked on the discharge tray 43 based on the distance measured by the upper surface distance measuring unit 19*b* and the height of the paper-supply tray 44 obtained from the rotation angle of the drive pulley 74, reads the rotation angle of the eccentric cam 72 corresponding to the calculated height of the upper surface from the LUT, and performs feedback control of the swing mechanism 37 so that the rotation angle measured by the swing drive amount measuring unit 16 becomes equal to the rotation angle read from LUT.

[Operation of the Document Conveying Apparatus]

Figure 13:
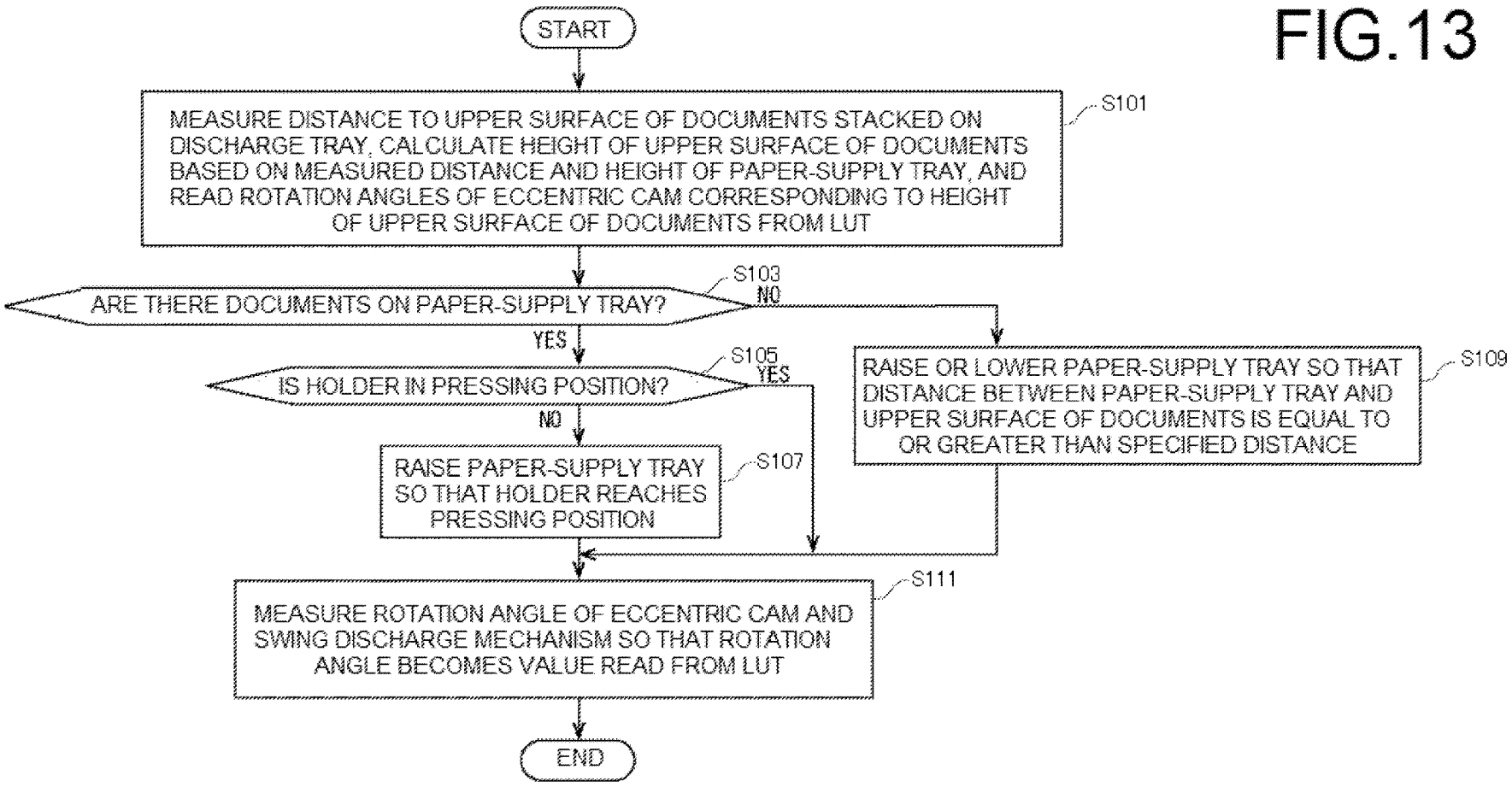
FIG. 13 is a flowchart illustrating a procedure of height control executed by a control unit of the third embodiment according to the present disclosure.

Next, with reference to FIG. 13, the height control of the document conveying apparatus 9 will be described. FIG. 13 is a flowchart illustrating the procedure of height control executed by the control unit 10. When the power supply to the printer 1 is turned ON, the control unit 10 repeatedly executes the height control illustrated in FIG. 13.

First, the control unit 10 causes the upper surface distance measuring unit 19*b* to measure the distance to the upper surface of the documents G stacked on the discharge tray 43, calculates the height of the upper surface of the documents G stacked on the discharge tray 43 based on the measured distance and the height of the paper-supply tray 44 obtained from the rotation angle of the drive pulley 74, and reads the rotation angle of the eccentric cam 72 corresponding to the calculated height of the upper surface from the LUT (step S101).

Next, the control unit 10 determines from the output signal of the paper-supply tray document detecting unit 17 whether or not there are documents G on the paper-supply tray 44 (step S103).

In a case where it is determined that there are documents G present on the paper-supply tray 44 (step S103: YES), the control unit 10 shifts to the processing of step S105, and based on the output signal of the feeding roller pressing detecting unit 21, determines whether or not the holder 53 of the feeding mechanism 34 is located at the pressing position. When it is determined that the holder 53 is located at the pressing position (step S105: YES), the control unit 10 proceeds to the processing of step S111. On the other hand, when it is determined that the holder 53 is not located at the pressing position (step S105: NO), the control unit 10 proceeds to the processing of step S107 and causes the raising/lowering mechanism 38 to raise the paper-supply tray 44 so that the holder 53 reaches the pressing position.

On the other hand, when it is determined that there are no documents G on the paper-supply tray 44 (step S103: NO), the control unit 10 moves to the processing of step S109, obtains the difference between the distance measured by the upper surface distance measuring unit 19*b* and the specified distance, and drives the raising/lowering mechanism 38 by a rotation angle corresponding to the raised or lowered amount represented by the obtained difference. With this operation, the paper-supply tray distance is adjusted to the minimum value at which the paper-supply tray 44 does not interfere with the discharged documents G and the discharge mechanism 36. In addition, a space in which documents G may be stacked is formed between the paper-supply tray 44 and the feeding roller 51.

Following step S107 or step S109, the control unit 10 causes the swing drive amount measuring unit 16 to measure the rotation angle of the eccentric cam 72, and causes the swing mechanism 37 to swing the discharge mechanism 36 so that the measured rotation angle becomes equal to the value read from the LUT (step S111). With this operation, the discharge difference is adjusted to an appropriate range in which the discharged documents G are not scattered and the discharged documents G do not interfere with the stacked documents G. Note that step S111 may be executed between step S101 and step S103.

Next, the operation of the document conveying apparatus 9 when documents G are stacked on the paper-supply tray 44 will be described with reference to FIGS. 14A to 16B. FIGS. 14A to 16B are cross-sectional views illustrating the operation of the document conveying apparatus 9.

Figure 14A:
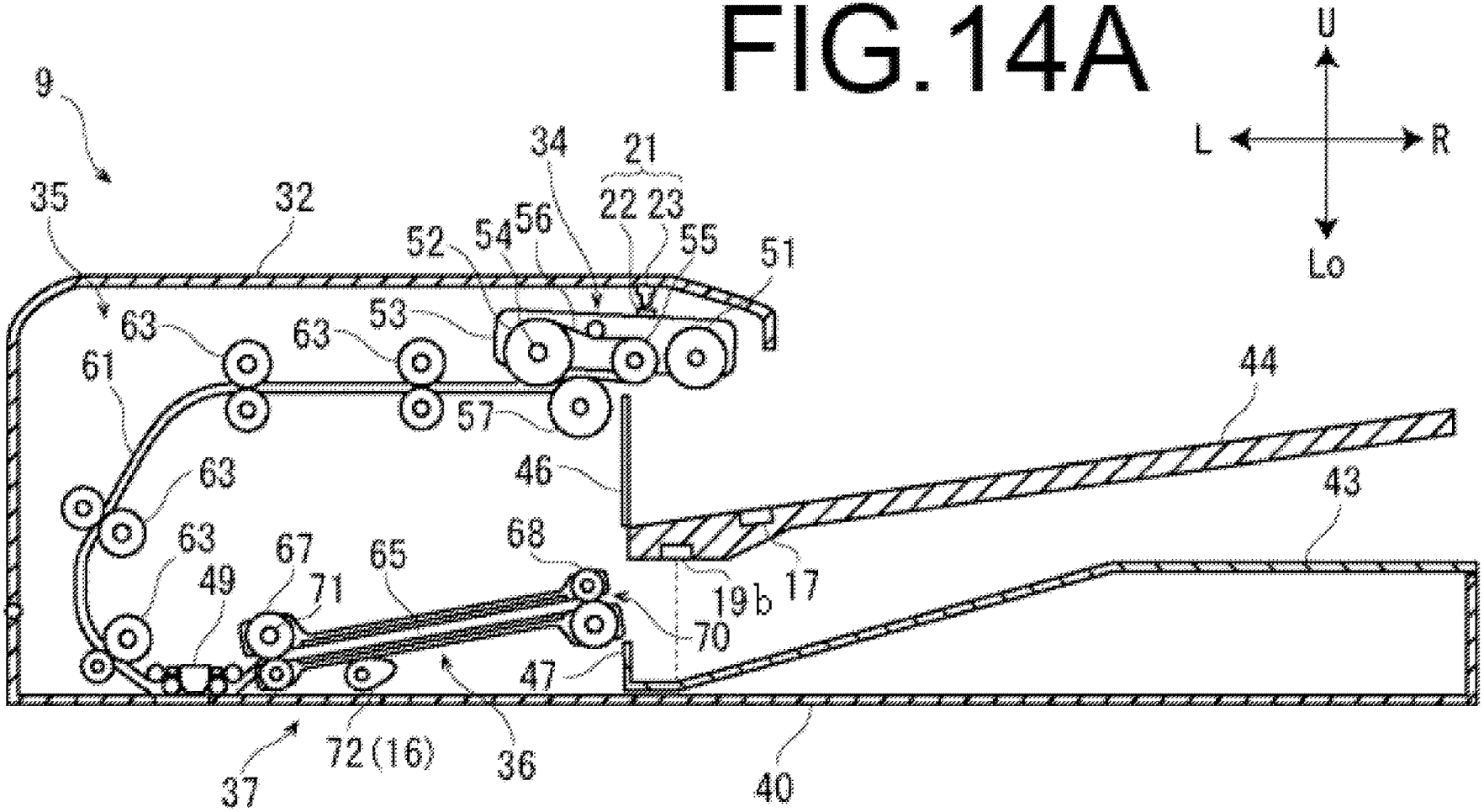
FIG. 14A is a cross-sectional view illustrating an operation of the document conveying apparatus of the third embodiment according to the present disclosure.

FIG. 14A illustrates a state before documents G are stacked on the paper-supply tray 44 and the discharge tray 43. In this, in step S101, the control unit 10 causes the upper surface distance measuring unit 19*b* to measure the distance to the upper surface of the discharge tray 43, calculates the height of the upper surface of the discharge tray 43 from the measured distance and the height of the paper-supply tray 44, and reads the rotation angles of the eccentric cam 72 and drive pulley 74 corresponding to the height of the upper surface of the discharge tray from the LUT; in step S103, determines that there are no documents G on the paper-supply tray 44 (step S103: NO); in step S109, causes the raising/lowering mechanism 38 to position the paper-supply tray 44 at the lower limit of the possible raising/lowering range; and in step S111, causes the swing mechanism 37 to position the discharge mechanism 36 at the lower limit position of the swingable range.

Figure 14B:
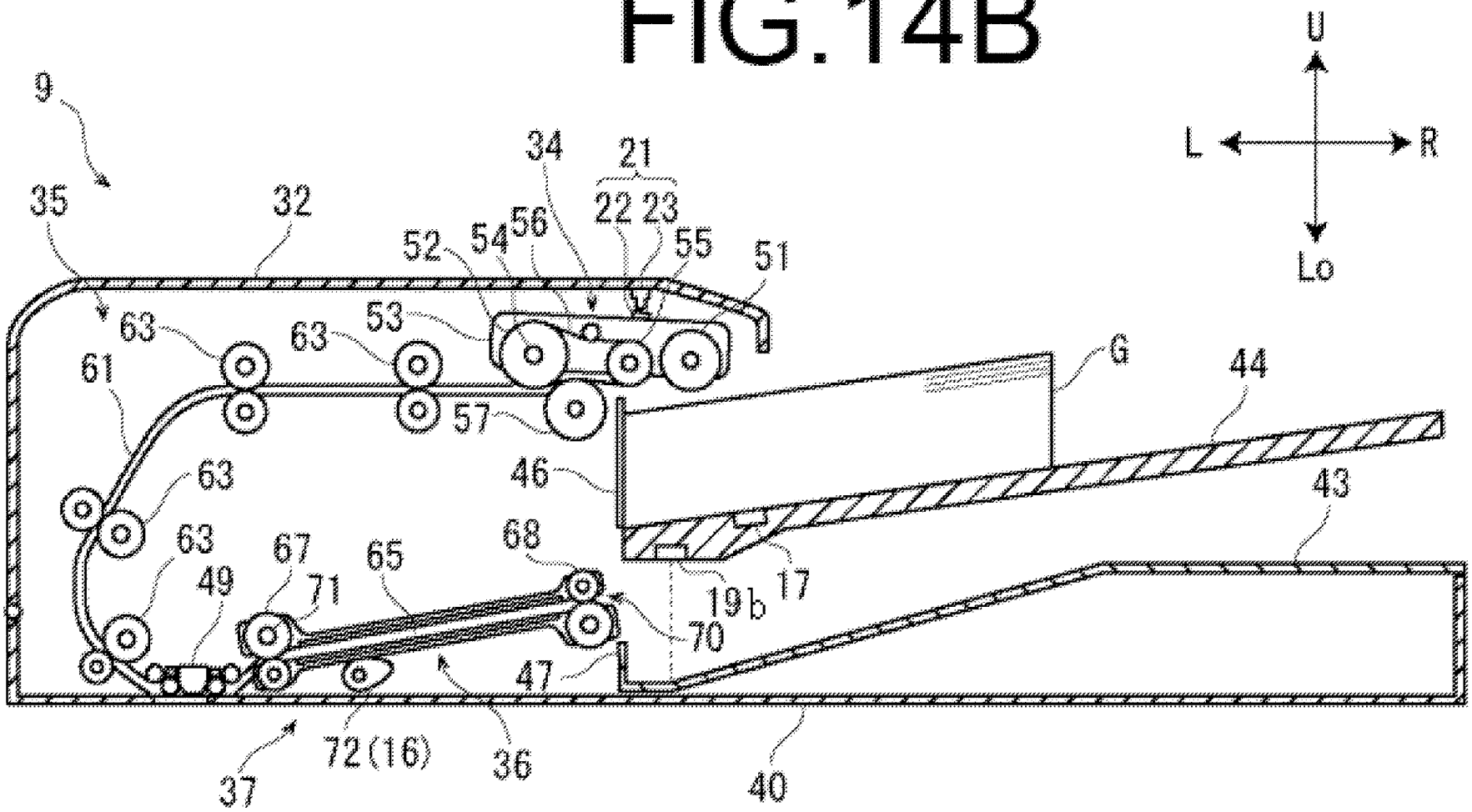
FIG. 14B is a cross-sectional view illustrating the operation of the document conveying apparatus of the third embodiment according to the present disclosure.

FIG. 14B illustrates a state in which documents G are stacked on the paper-supply tray 44. In this case, in step S101, the control unit 10 causes the upper surface distance measuring unit 19*b* to measure the distance to the upper surface of the discharge tray 43, and reads the rotation angles of the eccentric cam 72 and the drive pulley 74 corresponding to the height of the upper surface of the discharge tray from the LUT; in step S103, determines that there are documents G on the paper-supply tray 44 (step S103: YES); in step S105, determines that the holder 53 is not located at the pressing position (step S105: NO); and in step S107, causes the raising/lowering mechanism 38 to raise the paper-supply tray 44 so that the holder 53 reaches the pressing position. In step S111, the position of the discharge mechanism 36 is at the lower limit position of the swingable range and does not change (see FIG. 15A).

When an instruction to start reading is inputted in a state in which the holder 53 is positioned at the pressing position, the control unit 10 starts a reading job by causing the feeding mechanism 34 to feed documents G one sheet at a time to the conveying path 61, and causing the scanner 8 to read the documents G. The control unit 10 repeatedly executes height control in parallel with the reading job. In this case, in step S101, the control unit 10 causes the upper surface distance measuring unit 19*b* to measure the distance to the upper surface of the documents G stacked on the discharge tray 43 and reads the rotation angles of the eccentric cam 72 and the drive pulley 74 corresponding to the height of the upper surface of the documents G from the LUT; and in step S103, determines there are documents G on the paper-supply tray 44 (step S103: YES).

Figure 15A:
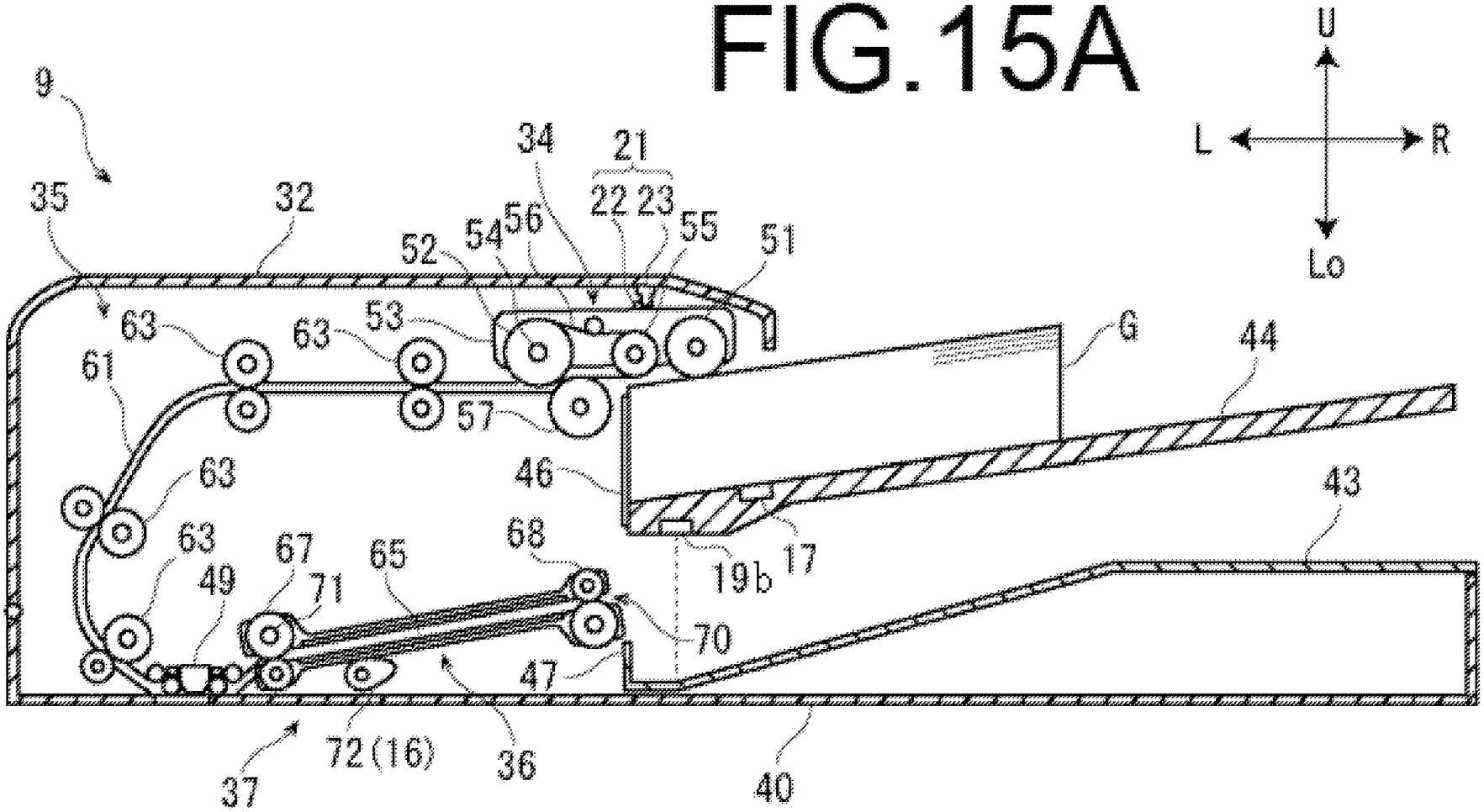
FIG. 15A is a cross-sectional view illustrating the operation of the document conveying apparatus of the third embodiment according to the present disclosure.
Figure 15B:
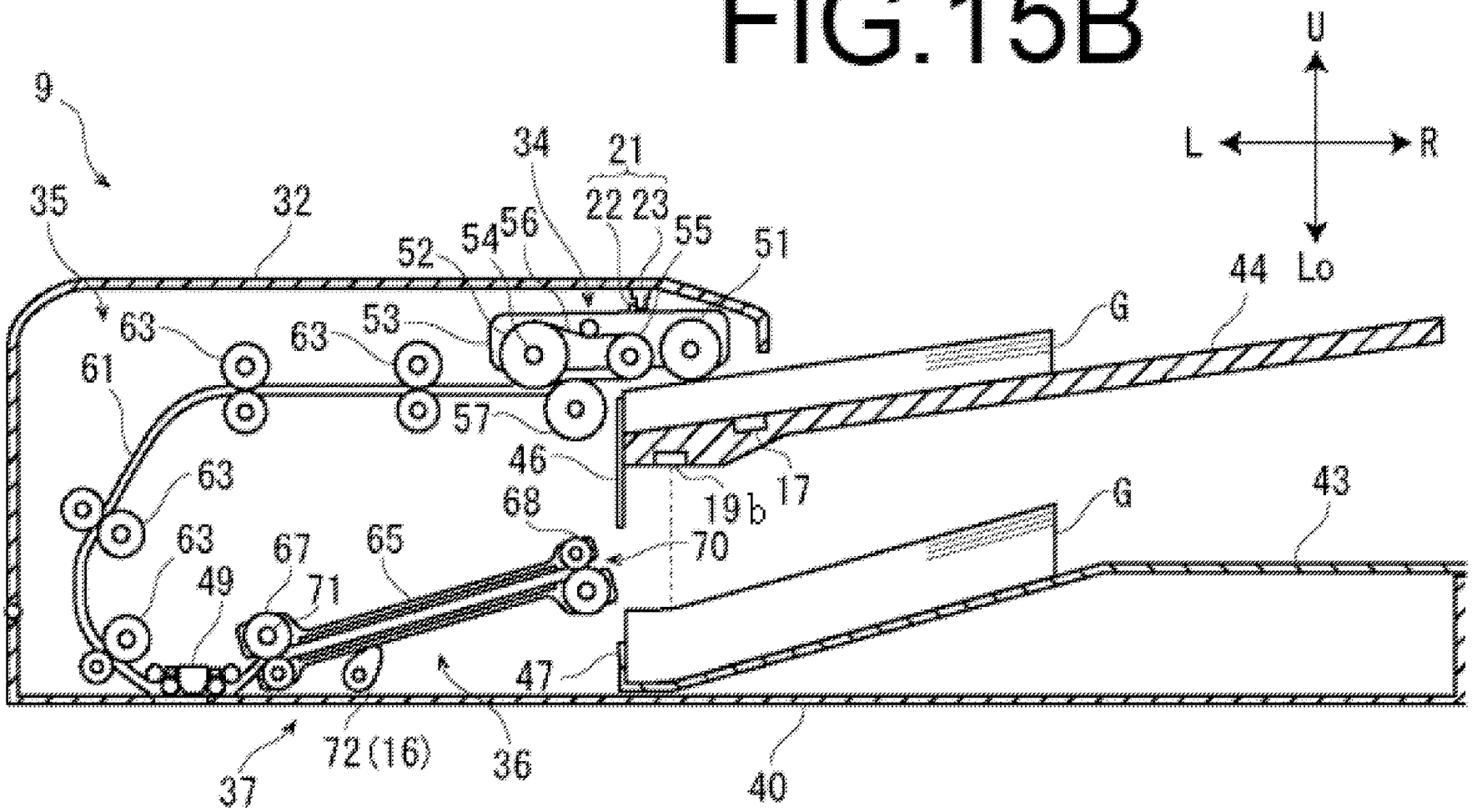
FIG. 15B is a cross-sectional view illustrating the operation of the document conveying apparatus of the third embodiment according to the present disclosure.

As the documents G are fed out, the height of the upper surface of the documents G stacked on the paper-supply tray 44 becomes lower, so the holder 53 swings downward. In a case where the holder 53 swings below the pressing position and the level of the signal outputted from the feeding roller pressing detecting unit 21 switches, the control unit 10 determines that the holder 53 is not located at the pressing position (step S105: NO), and in step S107, the control unit 10 causes the raising/lowering mechanism 38 to raise the paper-supply tray 44 so that the holder 53 reaches the pressing position, and restores the condition to a state in which the upper surface of the documents G stacked on the paper-supply tray 44 is pressed against the feeding roller 51. Then, in step S111, the control unit 10 causes the swing mechanism 37 to swing the discharge mechanism 36 upward. By this operation, the discharge difference is adjusted to an appropriate range. As an example, FIG. 15B illustrates a state in which approximately two-thirds of the documents G stacked on the paper-supply tray 44 have been read.

Figure 16A:
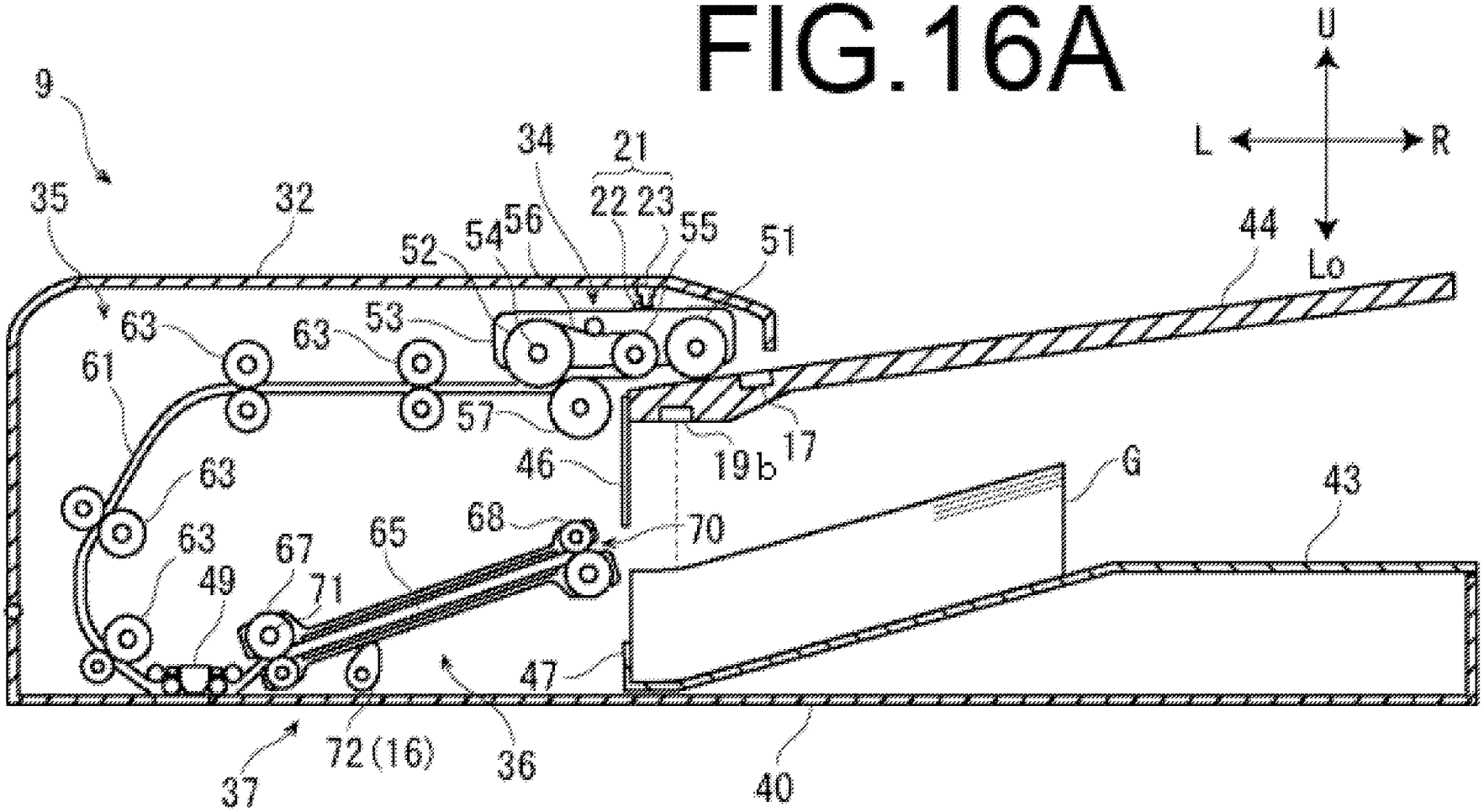
FIG. 16A is a cross-sectional view illustrating the operation of the document conveying apparatus of the third embodiment according to the present disclosure.
Figure 16B:
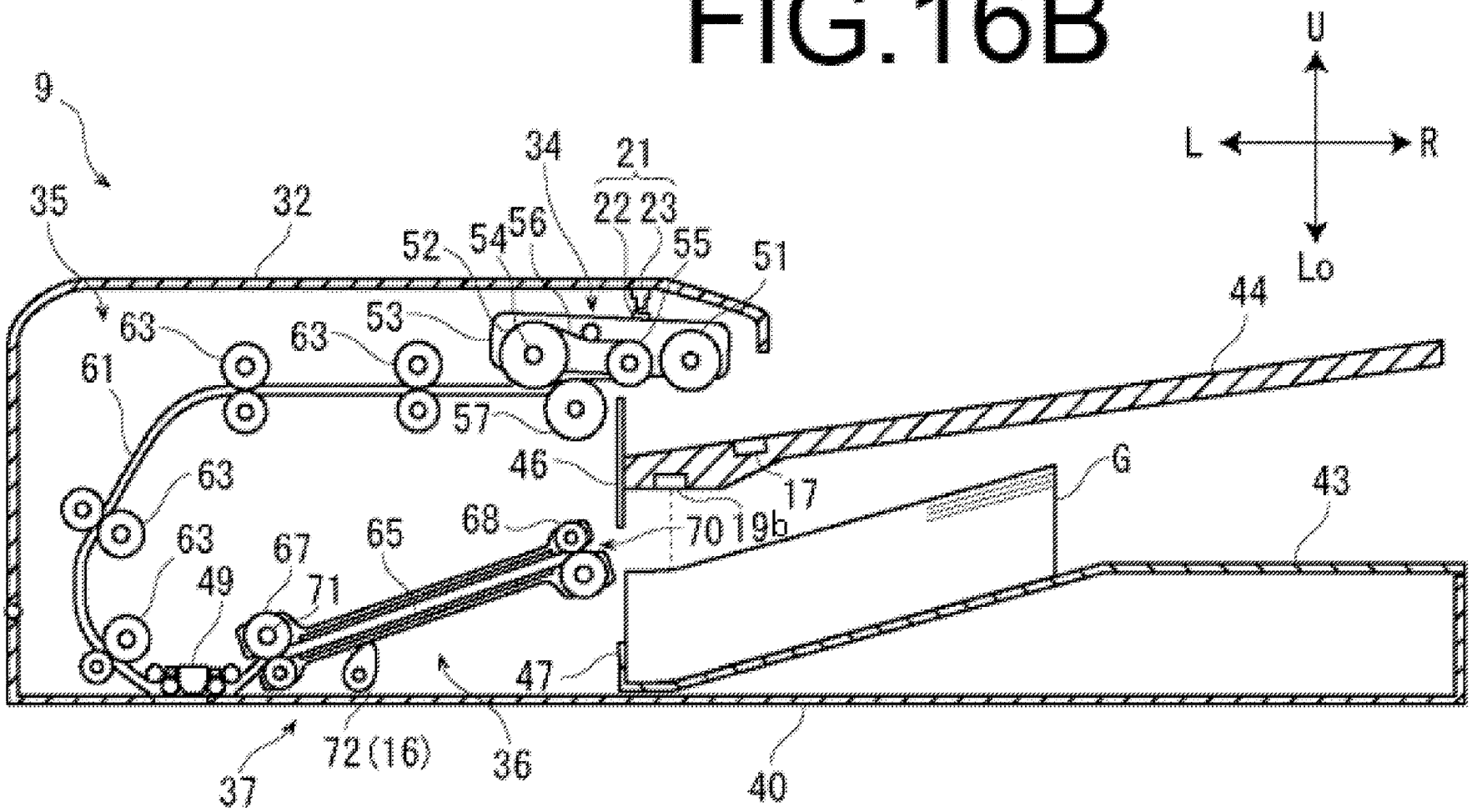
FIG. 16B is a cross-sectional view illustrating the operation of the document conveying apparatus of the third embodiment according to the present disclosure.

FIG. 16A illustrates a state in which all of the documents G have been read. In this case, in step S101, the control unit 10 causes the upper surface distance measuring unit 19*b* to measure the distance to the upper surface of the documents G stacked on the discharge tray 43, and reads the rotations angles of the eccentric cam 72 and the drive pulley 74 corresponding to the height of the upper surface of the documents G from the LUT; in step S103, determines that there are no documents G on the paper-supply tray 44 (step S103: NO); and in step S109, causes the raising/lowering mechanism 38 to lower the paper-supply tray 44. In this case, there are documents G stacked on the discharge tray 43, so the paper-supply tray distance is adjusted to the minimum value. In addition, a space in which documents G may be stacked is formed between the paper-supply tray 44 and the feeding roller 51. Then, in step S111, the control unit 10 causes the swing mechanism 37 to swing the discharge mechanism 36 upward. By this operation, the discharge difference is adjusted to an appropriate range (see FIG. 16B).

In a case where documents stacked on the discharge tray 43 have been removed, in step S101, the control unit 10 causes the upper surface distance measuring unit 19*b* to measure the distance to the upper surface of the discharge tray 43, and reads the rotation angles of the eccentric cam 72 and the drive pulley 74 corresponding to height of the upper surface of the discharge tray from the LUT; in step S103, determines that there are no documents G on the paper-supply tray 44 (step S103: NO); in step S109, causes the raising/lowering mechanism 38 to position the paper-supply tray 44 at the lower limit position of the possible raising/lowering range; and in step S111, causes the swing mechanism 37 to position the discharge mechanism 36 at the lower limit position of the swingable range (see FIG. 14A).

With the document conveying apparatus 9 according to the present embodiment described above, by calculating the height of the upper surface of the documents G stacked on the discharge tray 43 based on the distance measured by the upper surface distance measuring unit 19*b* and the height of the paper-supply tray 44 obtained from the driving amount of the raising/lowering mechanism 38 and causing the swing mechanism 37 to swing the discharge mechanism 36 according to the calculated height, the control unit 10 performs control so that the difference between the discharge port 70 and the upper surface of the documents G stacked on the discharge tray 43 is within a specified range. Therefore, with the document conveying apparatus 9 according to the present embodiment, documents G may be properly discharged regardless of the amount of documents G stacked on the discharge tray 43.

Moreover, with the document conveying apparatus 9 according to the present embodiment, in a case where there are no documents G stacked on the paper-supply tray 44, the control unit 10, by causing the raising/lowering mechanism 38 to raise or lower the paper-supply tray 44, performs control so that the distance measured by upper surface distance measuring unit 19*b* becomes equal to or greater than a specified distance. Therefore, with the document conveying apparatus 9 according to the present embodiment, it is possible to prevent the paper-supply tray 44 from interfering with the discharged documents G and the discharge mechanism 36.

What is claimed is:

1. A document conveying apparatus comprising:

a paper-supply tray on which documents are stacked;

a discharge tray provided below the paper-supply tray;

a feeding roller that feeds out the documents one sheet at a time from the paper-supply tray;

a conveying mechanism that conveys the fed documents along a conveying path that passes by a reading position;

a discharge mechanism that conveys the documents along a discharge path connected to the conveying path and discharges the documents to the discharge tray from a discharge port provided at an end portion on a downstream side in a conveying direction of the discharge path;

a swing mechanism at an end portion on the upstream side in the conveying direction of the discharge path and comprising a swing shaft, an axial direction of which is a width direction of the documents orthogonal to the conveying direction, and that swings the discharge mechanism centered around the swing shaft;

a raising/lowering mechanism that raises or lowers the paper-supply tray so that the upper surface of the documents stacked on the paper-supply tray is pressed against the feeding roller;

an upper surface height measuring unit provided above the discharge port position at an upper limit of a swingable range of the discharge mechanism, and that measures the height of the upper surface of the documents stacked on the discharge tray; and a control unit that, by causing the swing mechanism to swing the discharge mechanism according to the height measured by the upper surface height measuring unit, performs control so that a difference between the discharge port and the upper surface of the documents stacked on the discharge tray is within a specified range; wherein the control unit, in a case where the height of the upper surface of the documents stacked on the discharge tray is not raised even though the documents are fed out by the feeding roller, causes the feeding roller to stop feeding the documents.

2. The document conveying apparatus according to claim 1, wherein the control unit, in a case where the documents are not stacked on the paper-supply tray, by causing the raising/lowering mechanism to raise or lower the paper-supply tray according to the height measured by the upper surface height measuring unit, performs control so that the distance between the upper surface of the documents stacked on the discharge tray and the paper-supply tray is equal to or greater than a specified distance.

3. The document conveying apparatus according to claim 1, wherein the control unit, in a case where the height of the upper surface of the documents stacked on the discharge tray is equal to or greater than a threshold value, causes the feeding roller to stop feeding the documents.

4. A document conveying apparatus comprising:

a paper-supply tray on which documents are stacked;

a discharge tray provided below the paper-supply tray;

a feeding roller that feeds out the documents one sheet at a time from the paper-supply tray;

a conveying mechanism that conveys the fed documents along a conveying path that passes by a reading position;

a discharge mechanism that conveys the documents along a discharge path connected to the conveying path and discharges the documents to the discharge tray from a discharge port provided at an end portion on a downstream side in a conveying direction of the discharge path;

a swing mechanism at an end portion on the upstream side in the conveying direction of the discharge path and comprising a swing shaft, an axial direction of which is a width direction of the documents orthogonal to the conveying direction, and that swings the discharge mechanism centered around the swing shaft;

a raising/lowering mechanism that raises or lowers the paper-supply tray so that the upper surface of the documents stacked on the paper-supply tray is pressed against the feeding roller;

an upper surface distance measuring unit provided a lower surface of the paper-supply tray, and that measures a distance to the upper surface of the documents stacked on the discharge tray; and a control unit that calculates the height of the upper surface of the documents stacked on the discharge tray based on the distance measured by the upper surface distance measuring unit and the height of the paper-supply tray obtained from a drive amount of the raising/lowering mechanism, and by causing the swing mechanism to swing the discharge mechanism according to the calculated height, performs control so that the difference between the discharge port and the upper surface of the documents stacked on the discharge tray is within a specified range.

5. The document conveying apparatus according to claim 4, wherein the control unit, in a case where the documents are not stacked on the paper-supply tray, by causing the raising/lowering mechanism to raise or lower the paper-supply tray, performs control so that the distance measured by the upper surface distance measuring unit is equal to or greater than a specified distance.

6. The document conveying apparatus according to claim 4, wherein the control unit, in a case where the height of the upper surface of the documents stacked on the discharge tray is not raised even though the documents are fed out by the feeding roller, causes the feeding roller to stop feeding the documents.

7. The document conveying apparatus according to claim 4, wherein the control unit, in a case where the height of the upper surface of the documents stacked on the discharge tray is equal to or greater than a threshold value, causes the feeding roller to stop feeding the documents.

* * * * *